US009580201B2

(12) United States Patent
Willman et al.

(10) Patent No.: US 9,580,201 B2
(45) **Date of Patent: *Feb. 28, 2017**

(54) BLANK ASSEMBLY FOR FORMING A REINFORCED, STACKABLE TRAY CONTAINER

(71) Applicant: WestRock Shared Services, LLC, Norcross, GA (US)

(72) Inventors: James John Willman, Beaver Dam, WI (US); Craig Frederick Minsky, West Bend, WI (US)

(73) Assignee: WestRock Shared Services, LLC, Norcross, GA (US)

( * ) Notice: Subject to any disclaimer, the term of this patent is extended or adjusted under 35 U.S.C. 154(b) by 330 days.

This patent is subject to a terminal disclaimer.

(21) Appl. No.: 14/309,426

(22) Filed: Jun. 19, 2014

(65) Prior Publication Data

US 2014/0299655 A1 Oct. 9, 2014

Related U.S. Application Data

(63) Continuation of application No. 13/243,404, filed on Sep. 23, 2011, now Pat. No. 8,763,888.

(51) Int. Cl.
*B65D 5/10* (2006.01)
*B65D 5/00* (2006.01)
(Continued)

(52) U.S. Cl.
CPC ..... *B65D 5/0015* (2013.01); *B31B 7/26* (2013.01); *B65D 5/10* (2013.01); *B65D 5/445* (2013.01);
(Continued)

(58) Field of Classification Search
CPC ..... B65D 5/0015; B65D 5/10; B65D 5/445; B65D 5/542; B65D 5/0075
(Continued)

(56) References Cited

U.S. PATENT DOCUMENTS 2,817,473 A 12/1957 Foster
3,055,573 A 9/1962 Carter
(Continued)

OTHER PUBLICATIONS

PCT Search Report and Written Opinion, PCT/US2012/053918, Nov. 16, 2012 (7 pgs).

*Primary Examiner* — Nathan J Newhouse
*Assistant Examiner* — Phillip Schmidt
(74) *Attorney, Agent, or Firm* — WestRock IP Legal

(57) ABSTRACT

A blank assembly includes a tray blank having a first end panel assembly, a first side panel assembly, a second end panel assembly, and a second side panel assembly in series. Each panel assembly includes a removable pad panel. The tray blank further includes a bottom panel extending from each panel assembly at a fold line. The blank assembly further includes a first side insert blank configured to couple to the first side panel assembly. The first side insert blank having a removable pad panel configured to at least partially align with the removable pad panel of the first side panel assembly. A second side insert blank is configured to couple to the second side panel assembly. The second side insert blank includes a removable pad panel configured to at least partially align with the removable pad panel of the second side panel assembly.

20 Claims, 16 Drawing Sheets

(51) Int. Cl.
*B65D 5/44* (2006.01)
*B65D 5/54* (2006.01)
*B31B 7/26* (2006.01)

(52) U.S. Cl.
CPC ..... *B65D 5/542* (2013.01); *B31B 2217/0038* (2013.01)

(58) Field of Classification Search
USPC ..... 229/117, 919, 178, 240, 114
See application file for complete search history.

(56) References Cited

U.S. PATENT DOCUMENTS 3,125,274 A * 3/1964 Zinn ..... B65D 5/068 229/114
3,696,940 A 10/1972 Hoffman et al.
3,861,530 A 1/1975 Calvert
4,007,869 A * 2/1977 Stolkin ..... B65D 5/3621 229/117
4,156,484 A 5/1979 Wischusen
4,635,815 A 1/1987 Grigsby
4,706,809 A 11/1987 Halsell
4,787,509 A 11/1988 Pasternicki
5,316,210 A * 5/1994 Scullin ..... B65D 5/48048 229/117.16
5,535,942 A * 7/1996 Vilona ..... B65D 5/0075 229/122.32
5,927,593 A * 7/1999 Berkowitz ..... B65D 5/0281 229/117
5,950,911 A 9/1999 Naughton et al.
5,957,294 A * 9/1999 Kanter ..... B65D 5/5405 206/774
6,073,833 A * 6/2000 Desrosiers ..... B65D 5/5445 229/164
D437,222 S * 2/2001 Goldberg ..... D9/432
6,186,393 B1 2/2001 Tsamourgelis
6,402,021 B1 6/2002 Heathcock
6,405,921 B1 * 6/2002 Cochrane ..... A47F 5/112 206/503
6,719,191 B1 4/2004 Christensen et al.
7,624,912 B2 12/2009 Churvis
7,677,433 B2 3/2010 Little
7,810,707 B2 10/2010 Little
7,819,305 B2 10/2010 Little
7,861,916 B2 1/2011 Little
7,886,958 B2 2/2011 Smith
2003/0146130 A1 8/2003 Kanter et al.
2003/0226783 A1 * 12/2003 Jackson ..... B65D 5/542 206/772
2006/0157368 A1 7/2006 Kraft
2009/0057385 A1 3/2009 Quaintance et al.
2009/0286663 A1 11/2009 Little
2010/0065621 A1 3/2010 Quaintance
2010/0083618 A1 4/2010 Little
2010/0087304 A1 4/2010 Little
2010/0234201 A1 9/2010 Little et al.
2010/0247272 A1 9/2010 Little et al.
2011/0011922 A1 1/2011 Little
2012/0325830 A1 * 12/2012 Chapman ..... B65D 5/029 220/651

* cited by examiner

FIG. 13A

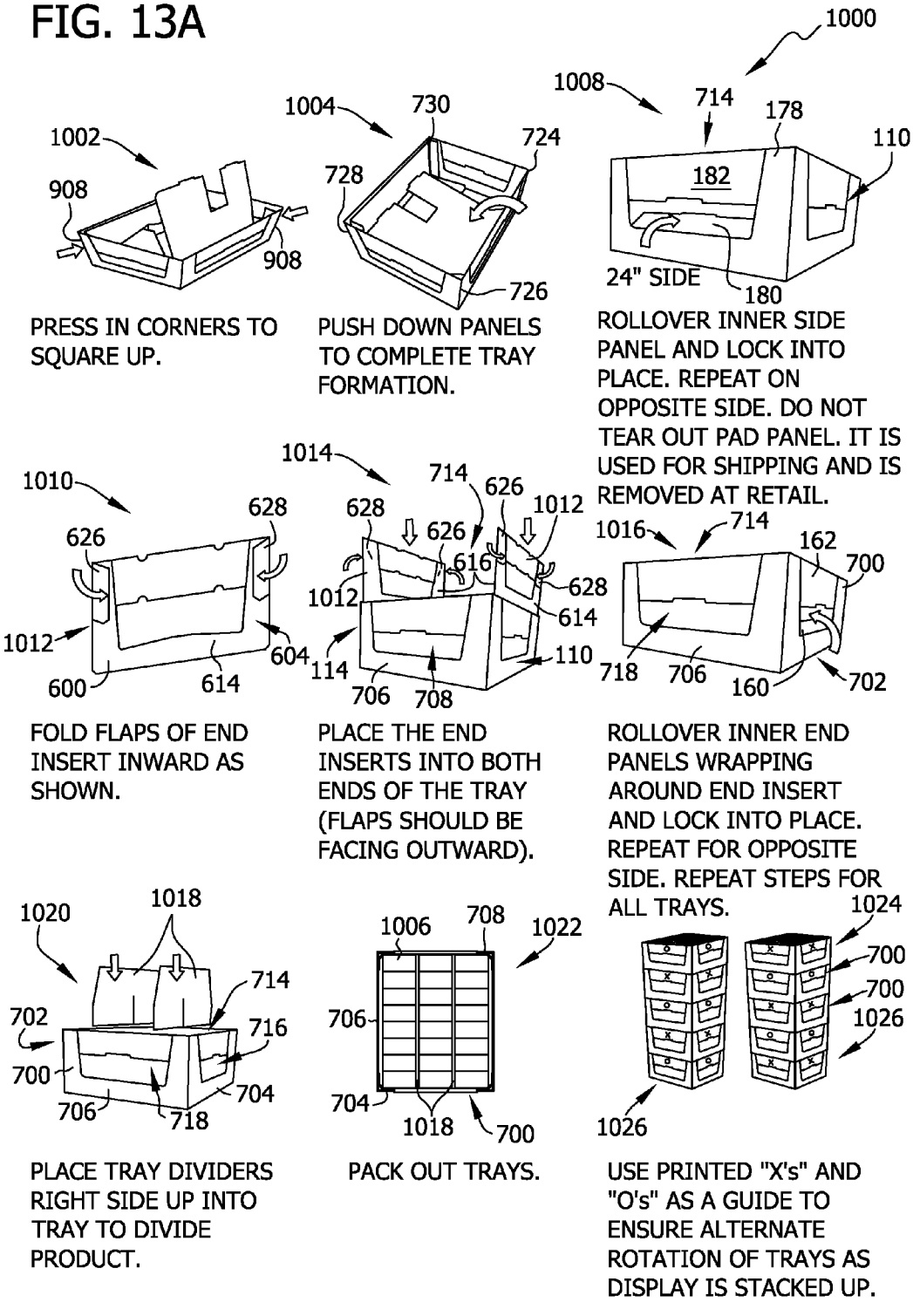

PRESS IN CORNERS TO SQUARE UP.

PUSH DOWN PANELS TO COMPLETE TRAY FORMATION.

ROLLOVER INNER SIDE PANEL AND LOCK INTO PLACE. REPEAT ON OPPOSITE SIDE. DO NOT TEAR OUT PAD PANEL. IT IS USED FOR SHIPPING AND IS REMOVED AT RETAIL.

FOLD FLAPS OF END INSERT INWARD AS SHOWN.

PLACE THE END INSERTS INTO BOTH ENDS OF THE TRAY (FLAPS SHOULD BE FACING OUTWARD).

ROLLOVER INNER END PANELS WRAPPING AROUND END INSERT AND LOCK INTO PLACE. REPEAT FOR OPPOSITE SIDE. REPEAT STEPS FOR ALL TRAYS.

PLACE TRAY DIVIDERS RIGHT SIDE UP INTO TRAY TO DIVIDE PRODUCT.

PACK OUT TRAYS.

USE PRINTED "X's" AND "O's" AS A GUIDE TO ENSURE ALTERNATE ROTATION OF TRAYS AS DISPLAY IS STACKED UP.

BLANK ASSEMBLY FOR FORMING A REINFORCED, STACKABLE TRAY CONTAINER

CROSS REFERENCE TO RELATED APPLICATIONS

This application is a continuation application of U.S. patent application Ser. No. 13/243,404, filed Sep. 23, 2011, entitled "BLANK ASSEMBLY FOR FORMING A REINFORCED, STACKABLE TRAY CONTAINER", the disclosure of which is hereby incorporated herein by reference in its entirety.

BACKGROUND OF THE INVENTION

The embodiments described herein relate generally to a tray container for shipping and displaying products and, more particularly, to a blank assembly for forming a reinforced tray container capable of nesting within another such tray container when the tray containers are stacked.

At least some known tray containers are used for shipping and displaying products. More specifically, such tray containers include side walls that are open to display the product therein and enable access to the products through the opening in the side walls. However, end walls of such containers are solid and do not enable viewing of or access to the products. As such, the containers can only be used in a limited number of orientations when used for display.

Further, with respect to the known trays, a shipping pad is usually placed in the opening of the side walls to prevent damage to the products during shipping and/or provide additional support to the container during shipping. This shipping pad is a separate piece that must be shrink wrapped, or otherwise coupled, to the known tray during shipping and is not part of the tray wall. At least one of the known tray containers includes a center divider.

Additionally, at least some of the known trays are not knocked-down flat type containers and, thus, requires numerous steps and/or a machine to erect the tray. These known trays also do not include an automatically-erecting bottom wall having a substantially double-overlapping bottom wall.

BRIEF DESCRIPTION OF THE INVENTION

In one aspect, a blank assembly for forming a reinforced tray container is provided. The blank assembly includes a tray blank having a first end panel assembly, a first side panel assembly, a second end panel assembly, and a second side panel assembly in series. Each panel assembly includes a removable pad panel. The tray blank further includes a bottom panel extending from each panel assembly at a fold line. The blank assembly further includes a first side insert blank configured to couple to the first side panel assembly. The first side insert blank having a removable pad panel configured to at least partially align with the removable pad panel of the first side panel assembly. A second side insert blank is configured to couple to the second side panel assembly. The second side insert blank includes a removable pad panel configured to at least partially align with the removable pad panel of the second side panel assembly.

In another aspect, a reinforced tray container is provided. The tray container includes a pair of opposing side walls each having a side panel, reinforcing side panel, and a side pad panel assembly connected to the side panel and the reinforcing side panel. The side panel assembly is configured to be separated from the side panel and the reinforcing side panel for removal from a respective side wall. A pair of opposing end walls each include an end panel and an end pad panel connected to the end panel. The pad panel is configured to be separated from the end panel for removal from a respective end wall. A bottom wall is connected to the pair of side walls and the pair of end walls. The bottom wall configured to fold into a cavity of the container to transition the container from an erect configuration to a knocked-down flat configuration.

In yet another aspect, a method for forming a reinforced tray container from a blank assembly is provided. The blank assembly includes a tray blank having a first end panel assembly, a first side panel assembly, a second end panel assembly, and a second side panel assembly in series, wherein each panel assembly comprises a removable pad panel. The tray blank further includes a first bottom end panel assembly extending from the first end panel assembly, a first bottom side panel extending from the first side panel assembly, a second bottom end panel extending from the second end panel assembly, and a second side panel assembly extending from the second side panel assembly. The blank assembly further includes a first side insert blank having a removable pad panel, and a second side insert blank having a removable pad panel. The method includes coupling the first side insert blank to the first side panel assembly such that the pad panel of the first side insert blank is substantially aligned with the removable pad panel of the first side panel assembly, coupling the second side insert blank to the second side panel assembly such that the pad panel of the second side insert blank is substantially aligned with the removable pad panel of the second side panel assembly, coupling a coupling panel of the first bottom end panel assembly to the second bottom end panel, and coupling a coupling panel of the second bottom side panel assembly to the second bottom end panel, wherein the first bottom end panel assembly, the first bottom side panel, the second bottom end panel, and the second side panel assembly are positioned between the panel assemblies.

BRIEF DESCRIPTION OF THE DRAWINGS

FIGS. 1-15 show exemplary embodiments of the apparatus and methods described herein.

FIG. 1 is a top view of an interior surface of an exemplary tray blank of sheet material for forming a container.

FIG. 2 is a top view of an interior surface of an exemplary first side insert blank of sheet material for forming the container.

FIG. 3 is a top view of a plurality of the first side insert blanks shown in FIG. 2.

FIG. 4 is a top view of an interior surface of an exemplary second side insert blank of sheet material for forming the container.

FIG. 5 is a top view of a plurality of the second side insert blanks shown in FIG. 4.

FIG. 6 is a top view of an exterior surface of an exemplary end insert blank of sheet material for forming the container.

FIG. 7 is a top view of a plurality of the end insert blanks shown in FIG. 6.

FIG. 8 is a perspective view of an exemplary container formed from a blank assembly shown in FIGS. 1-7.

FIG. 9 is a top view of an end portion of the container shown in FIG. 9.

FIG. 10 is a perspective view of the container shown in FIG. 8 in a display configuration.

FIG. 11 is a schematic view of an exemplary method for assembling the blanks shown in FIGS. 1-7 into a formed or assembled blank.

FIG. 12 is a schematic view of an exemplary method for forming a knocked-down flat container from the assembled blank shown in FIG. 11.

FIGS. 13A and 13B are a schematic view of an exemplary method for erecting and stacking the container shown in FIG. 8 from the knocked-down flat container shown in FIG. 12.

FIG. 14 is a schematic view of an exemplary method for converting the container shown in FIG. 8 to the display configuration shown in FIG. 10.

FIG. 15 is a perspective view of a plurality of stacked containers that may be achieved using the methods shown in FIGS. 13A, 13B, and 14.

DETAILED DESCRIPTION OF THE INVENTION

Figure 1:
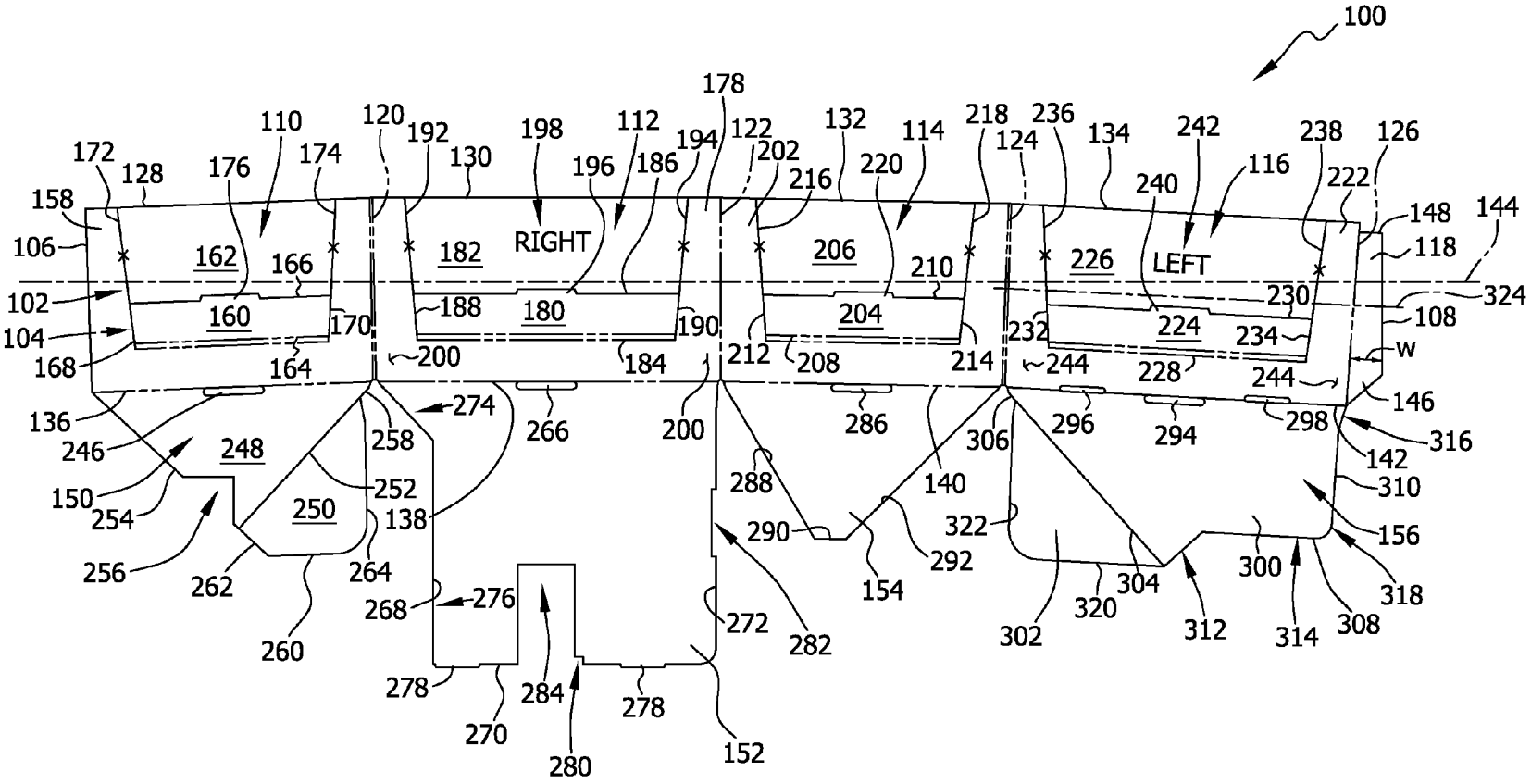

The embodiments described herein provide a tray container that includes openings through side and end walls to enable viewing of and access to products within the container through the side walls and the end walls. Further, the tray container includes reinforced corners to enable stacking of the tray containers without damages to the corners. Moreover, the tray container includes removable side and end wall panels that provide support to the container during shipping. As such, additional shipping pads are not required during shipping. Additionally, the herein-described tray container includes an auto-forming bottom and can be formed in six steps. The auto-forming bottom further enables the tray container to be shipped and/or stored in a knocked-down flat configuration, and includes a substantially double-layered bottom wall.

The tray described herein is configured to support and/or contain a plurality of containers and/or products. For example, the trays can be used to contain food products, such as condiments, packages of dairy products, and/or snack items, during transport, storage, and/or display of the products.

The following detailed description illustrates the disclosure by way of example and not by way of limitation. The description clearly enables one skilled in the art to make and use an exemplary container, describes several embodiments, adaptations, variations, alternatives, and use of the blanks and/or containers, including what is presently believed to be the best mode of carrying out the disclosure.

A tray container formed from a single sheet of material and methods for constructing the container are described herein. The tray container may be constructed from a plurality of blanks of sheet material using at least one machine. In one embodiment, the blanks are fabricated from a cardboard material. The blanks, however, may be fabricated using any suitable material, and therefore are not limited to a specific type of material. In alternative embodiments, the blanks are fabricated using cardboard, plastic, fiberboard, paperboard, foamboard, corrugated paper, and/or any suitable material known to those skilled in the art and guided by the teachings herein provided.

In an example embodiment, the tray container includes at least one marking thereon including, without limitation, indicia that communicates the product stored in the tray, a manufacturer of the product, and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the tray is void of markings, such as, without limitation, indicia that communicates the product, a manufacturer of the product and/or a seller of the product.

The tray container described herein is formed from a blank assembly including a tray blank, two side insert blanks, and two end insert blanks. Referring now to the drawings, FIG. 1 is a top view of an exemplary tray blank 100 of sheet material for forming a tray container, such as a container 700 (shown in FIGS. 8-10). Blank 100 has a first or interior surface 102 and an opposing second or exterior surface 104. Further, blank 100 defines a first edge 106 and an opposing second edge 108. In one embodiment, blank 100 includes, in series from first edge 106 to second edge 108, a first end panel assembly 110, a first side panel assembly 112, a second end panel assembly 114, a second side panel assembly 116, and a glue panel 118 coupled together along preformed, generally parallel, fold lines 120, 122, 124, and 126, respectively. Fold lines 120, 122, 124, and/or 126, as well as other fold lines and/or hinge lines described herein, may include any suitable crease, line of weakening, and/or line of separation known to those skilled in the art and guided by the teachings herein provided.

More specifically, first end panel assembly 110 extends from first edge 106 to fold line 120, first side panel assembly 112 extends from first end panel assembly 110 along fold line 120, second end panel assembly 114 extends from first side panel assembly 112 along fold line 122, second side panel assembly 116 extends from second end panel assembly 114 along fold line 124, and glue panel 118 extends from second side panel assembly 116 along fold line 126 to second edge 108. In the exemplary embodiment, fold line 120 and fold line 124 each include a pair of parallel lines of weakness to facilitate forming container 700 from blank 100 using a machine. More specifically, fold lines 120 and 124 allow for insert blanks 400 and 500 (shown in FIGS. 2 and 4) to be glued to blank 100 and for assembled blanks 100, 400, and 500 to be formed into a knocked-down flat container.

In the exemplary embodiment, each panel assembly 110, 112, 114, and 116 includes a respective free top edge 128, 130, 132, or 134. Free top edges 128, 130, 132, and 134 define a slight arc from first edge 106 to fold line 126 such that, when container 700 is formed, side and end walls of container 700 taper outward from a bottom edge toward a top edge, as described in more detail below. Similarly, each panel assembly 110, 112, 114, and 116 includes a respective bottom fold line 136, 138, 140, or 142. Fold lines 136, 138, 140, and 142 define a slight arc from first edge 106 to fold line 126 such that, when container 700 is formed, side and end walls of container 700 taper outward from a bottom edge toward a top edge, as described in more detail below. In the exemplary embodiment, each top edge 128, 130, 132, and 134 is substantially parallel to a respective bottom fold line 136, 138, 140, or 142, and top edges 128, 130, 132, and 134 and bottom fold lines 136, 138, 140, and 142 are each substantially linear. Because each bottom fold line 136, 138, 140, and 142 is shorter than a respective top edge 128, 130, 132, or 134, blank 100 has the slight arc from first edge 106 to fold line 126 with respect to longitudinal axis 144 of blank 100.

Glue panel 118 is wider toward a bottom edge 146 than at a top edge 148 such that second edge 108 is substantially perpendicular to a longitudinal axis 144 of blank 100 to facilitate assembling blanks 100, 400, and 500 using a machine. For example, a width W is the widest portion of glue panel 118. Alternatively, glue panel 118 has any suitable shape that enables container 700 to be formed from blank 100.

A first bottom end panel assembly 150 extends from first end panel assembly 110 along fold line 136, a first bottom side panel 152 extends from first side panel assembly 112 along fold line 138, a second bottom end panel 154 extends from second end panel assembly 114 along fold line 140, and a second bottom side panel assembly 156 extends from second side panel assembly 116 along fold line 142. When container 700 is formed from blank 100, fold line 136 defines a bottom edge of first end panel assembly 110 and an end edge of bottom end panel assembly 150; fold line 138 defines a bottom edge of first side panel assembly 112 and a side edge of first bottom side panel 152; fold line 140 defines a bottom edge of second end panel assembly 114 and an end edge of second bottom end panel 154; and fold line 142 defines a bottom edge of second side panel assembly 116 and a side edge of second bottom side panel assembly 156.

First end panel assembly 110 includes top edge 128 that is substantially parallel to fold line 136 and slightly longer than fold line 136. First end panel assembly 110 further includes an end panel 158, an inner end panel 160, and a pad panel 162. More specifically, inner end panel 160 and pad panel 162 are defined in end panel 158. In the exemplary embodiment, inner end panel 160 is defined by a horizontal hinge line 164, a horizontal perforated line 166, and two generally vertical perforated lines 168 and 170. Horizontal perforated line 166 separates pad panel 162 from inner end panel 160. Pad panel 162 is further defined by top edge 128 and two generally vertical tear lines 172 and 174 that are substantially co-linear with perforated lines 168 and 170, respectively. Tear lines 172 and 174 are configured to enable pad panel 162 to be removed from first end panel assembly 110 by a user, as described in more detail below. Alternatively, tear lines 172 and/or 174 are other than co-linear with perforated lines 168 and/or 170. In a particular embodiment, pad panel 162 includes indicia (not shown), such as an "X" or an "O", embossed and/or printed on exterior surface 104 thereof to facilitate stacking a plurality of containers 700. In the exemplary embodiment, perforated lines 168 and 170 and tear lines 172 and 174 diverge from the bottom toward top edge 128. In an alternative embodiment, perforated lines 168 and 170 and tear lines 172 and 174 have any suitable configuration that enables container 700 to function as described herein. In the exemplary embodiment, horizontal perforated line 166 defines a tab 176 that extends upward from inner end panel 160.

More specifically, the indicia (i.e. the "X"s and "O"s) printed on exterior surface 104 of tray blank 100 assists a user to properly orient multiple containers stacked on one another and facilitates proper alignment of the stack of containers, as described in more detail below.

First side panel assembly 112 includes top edge 130 that is substantially parallel to fold line 138 and slightly longer than fold line 138. First side panel assembly 112 further includes a side panel 178, an inner side panel 180, and a pad panel 182. More specifically, inner side panel 180 and pad panel 182 are defined in side panel 178. In the exemplary embodiment, inner side panel 180 is defined by a horizontal hinge line 184, a horizontal perforated line 186, and two generally vertical perforated lines 188 and 190. Horizontal perforated line 186 separates pad panel 182 from inner side panel 180. Pad panel 182 is further defined by top edge 130 and two generally vertical tear lines 192 and 194 that are substantially co-linear with perforated lines 188 and 190, respectively. Tear lines 192 and 194 are configured to enable pad panel 182 to be removed from first side panel assembly 112 by a user, as described in more detail below. Alternatively, tear lines 192 and/or 194 are other than co-linear with perforated lines 188 and/or 190. In the exemplary embodiment, perforated lines 188 and 190 and tear lines 192 and 194 diverge from the bottom toward top edge 130. In an alternative embodiment, perforated lines 188 and 190 and tear lines 192 and 194 have any suitable configuration that enables container 700 to function as described herein. In the exemplary embodiment, horizontal perforated line 186 defines a tab 196 that extends upwardly from inner side panel 180. Indicia 198 can be embossed on interior surface 102 of pad panel 182, and alignment marks 200 can be embossed on side panel 178 to facilitate assembling blanks 100 and 400 into a formed blank, which is described in more detail below. In a particular embodiment, pad panel 182 includes indicia (not shown), such as an "X" or an "O", embossed and/or printed on exterior surface 104 thereof to facilitate stacking a plurality of containers 700.

Second end panel assembly 114 includes top edge 132 that is substantially parallel to fold line 140 and slightly longer than fold line 140. Second end panel assembly 114 further includes an end panel 202, an inner end panel 204, and a pad panel 206. More specifically, inner end panel 204 and pad panel 206 are defined in end panel 202. In the exemplary embodiment, inner end panel 204 is defined by a horizontal hinge line 208, a horizontal perforated line 210, and two generally vertical perforated lines 212 and 214. Horizontal perforated line 210 separates pad panel 206 from inner end panel 204. Pad panel 206 is further defined by top edge 132 and two generally vertical tear lines 216 and 218 that are substantially co-linear with perforated lines 212 and 214, respectively. Tear lines 216 and 218 are configured to enable pad panel 206 to be removed from second end panel assembly 114 by a user, as described in more detail below. Alternatively, tear lines 216 and/or 218 are other than co-linear with perforated lines 212 and/or 214. In the exemplary embodiment, perforated lines 212 and 214 and tear lines 216 and 218 diverge from bottom toward top edge 132. In an alternative embodiment, perforated lines 212 and 214 and tear lines 216 and 218 have any suitable configuration that enables container 700 to function as described herein. In the exemplary embodiment, horizontal perforated line 210 defines a tab 220 that extends upward from inner end panel 204. In a particular embodiment, pad panel 206 includes indicia (not shown), such as an "X" or an "O", embossed and/or printed on exterior surface 104 thereof to facilitate stacking a plurality of containers 700.

Second side panel assembly 116 includes top edge 134 that is substantially parallel to fold line 142 and slightly longer than fold line 142. Second side panel assembly 116 further includes a side panel 222, an inner side panel 224, and a pad panel 226. More specifically, inner side panel 224 and pad panel 226 are defined in side panel 222. In the exemplary embodiment, inner side panel 224 is defined by a horizontal hinge line 228, a horizontal perforated line 230, and two generally vertical perforated lines 232 and 234. Horizontal perforated line 230 separates pad panel 226 from inner side panel 224. Pad panel 226 is further defined by top edge 134 and two generally vertical tear lines 236 and 238 that are substantially co-linear with perforated lines 232 and 234, respectively. Tear lines 236 and 238 are configured to enable pad panel 226 to be removed from second side panel assembly 116 by a user, as described in more detail below. Alternatively, tear lines 236 and/or 238 are other than co-linear with perforated lines 232 and/or 234. In the exemplary embodiment, perforated lines 232 and 234 and tear lines 236 and 238 diverge from bottom toward top edge 134. In an alternative embodiment, perforated lines 232 and 234 and tear lines 236 and 238 have any suitable configuration that enables container 700 to function as described herein. In the exemplary embodiment, horizontal perforated line 230 defines a tab 240 that extends upward from inner side panel 224. Indicia 242 can be embossed on interior surface 102 of pad panel 226, and alignment marks 244 can be embossed on side panel 222 to facilitate assembling blanks 100 and 500 into the formed blank. In a particular embodiment, pad panel 226 includes indicia (not shown), such as an "X" or an "O", embossed and/or printed on exterior surface 104 thereof to facilitate stacking a plurality of containers 700. For example, first end pad panel 162 and first side pad panel 182 include "X"s and second end pad panel 206 and second end pad panel 226 include "O"s.

First bottom end panel assembly 150 extends from first end panel 158 along fold line 136. A slot 246 is defined along fold line 136. First bottom end panel assembly 150 includes a first bottom end panel 248 and a coupling panel 250 extending from bottom end panel 248 along a fold line 252. Bottom end panel 248 includes a first free edge 254 that extends at an angle from an intersection of first edge 106 of blank 100 and fold line 136. First free edge 254 includes a notch 256 shaped to correspond to a shape of second bottom side panel assembly 156. Bottom end panel 248 further includes a second free edge 258 that extends at an angle from an intersection of fold line 136 and fold line 120. Second free edge 258 is substantially co-linear with fold line 252. Coupling panel 250 includes a free bottom edge 260 and two free side edges 262 and 264. Free side edge 262 extends co-linearly from first free edge 254 to bottom edge 260. Bottom edge 260 is substantially parallel to fold line 136, and free side edge 264 is substantially parallel to fold line 120. A rounded corner is defined between edges 260 and 264; although, any suitably shaped corner can be defined between edges 260 and 264. Further, side edge 264 tapers inwardly toward fold line 252 and/or second free edge 258. Alternatively, side edge 264 can be substantially straight and/or have any other suitable configuration.

First bottom side panel 152 extends from first side panel 178 along fold line 138. A slot 266 is defined along fold line 138. First bottom side panel 152 is defined by fold line 138, a first free side edge 268, a free bottom edge 270, and a second free side edge 272. First free side edge 268 includes an inwardly tapered portion 274 and a vertical portion 276. Inwardly tapered portion 274 is configured to enable vertical portion 276 to pass over top edge 128 of a first end wall 704 (shown in FIG. 8) when container 700 is transitioned between a knocked-down flat configuration and an erect configuration. Free bottom edge 270 defines a pair of tabs 278 that extend from first bottom side panel 152 and a notch 280 configured to correspond to a slot 294 to prevent first bottom side panel 152 from overlapping slot 294. Second free side edge 272 defines an indentation 282 that corresponds to a slot 286 to prevent first bottom side panel 152 from overlapping slot 286.

A cutout 284 that enables the assembled blanks to be formed into the knocked-down flat container is defined by free bottom edge 270. More specifically, in one embodiment, a machine used to fold and glue the assembled blanks into the knocked-down flat container does not allow a depth of a bottom panel to exceed a depth of a side or end panel. However, a depth of first bottom side panel 152 is larger than a depth any of panel assemblies 110, 112, 114, and/or 116. As such, to avoid the depth limitation of the machine, cutout 284 is configured such that first bottom side panel 152 is sensed by the machine as being within the depth limitation. In an alternative embodiment, cutout 284 is omitted.

Second bottom end panel 154 extends from second end panel 202 along fold line 140. A slot 286 is defined along fold line 140. Second bottom end panel 154 is defined by fold line 140, a first free side edge 288, a free bottom edge 290, and a second free side edge 292. First free side edge 288 extends at an angle from an intersection of fold line 140 and fold line 122 and is configured to enable first bottom side panel 152 to be moved past second bottom end panel 154 when container 700 is transitioned between the knocked-down flat configuration and the erect configuration. Free bottom edge 290 is substantially parallel to fold line 140 and extends between free side edges 288 and 292. Free bottom edge 290 is substantially shorter than fold line 140 such that second bottom end panel tapers from top to bottom. Second free side edge 292 extends at an angle from an intersection of fold lines 140 and 124 and is configured to correspond to a fold line 304 to enable transitioned between the knocked-down flat configuration and the erect configuration.

Second bottom side panel assembly 156 extends from second side panel 222 along fold line 142. A slot 294 and slots 296 and 298 are defined along fold line 142. Slots 296 and 298 are configured to receive tabs 278 of first bottom side panel 152 when container 700 is in the erect configuration. Second bottom side panel assembly 156 includes a second bottom side panel 300 and a coupling panel 302 extending from bottom side panel 300 along a fold line 304. Bottom side panel 300 includes a first free side edge 306, a free bottom edge 308, and a second free side edge 310. First free side edge 306 extends at an angle from an intersection of fold line 142 and fold line 124. First free side edge 306 is substantially co-linear with fold line 304. Bottom edge 308 includes an angled portion 312 and a horizontal portion 314 that are configured to correspond to a shape of first bottom end panel assembly 150 to prevent bottom panel overlap that would form an other than flat bottom wall 712 (shown in FIG. 8) when container 700 is in the erect configuration. Second free side edge 310 includes a tapered portion 316 and a vertical portion 318 that are configured to enable inner side panel 224 to be folded for insertion of tab 240 into slot 294, as described in more detail below. Coupling panel 302 includes a free bottom edge 320 and a free side edge 322. Bottom edge 320 is substantially parallel to fold line 142, and free side edge 322 is substantially parallel to fold line 124. A rounded corner is defined between edges 320 and 322; although, any suitably shaped corner can be defined between edges 320 and 322. Further, side edge 322 tapers inwardly toward fold line 304 and/or first free side edge 306. Alternatively, side edge 322 can be substantially straight and/or have any other suitable configuration.

Figure 2:
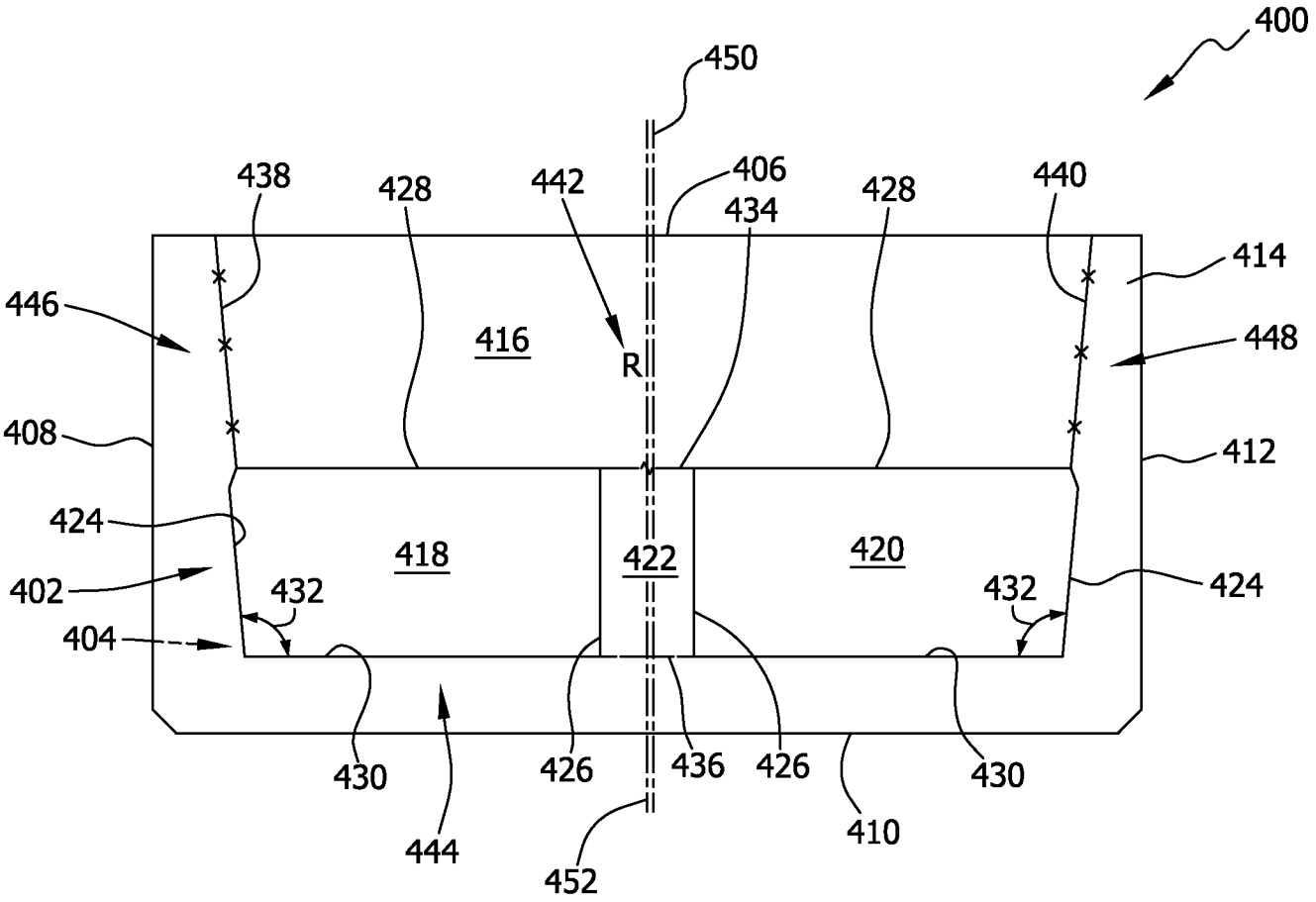
Figure 8:
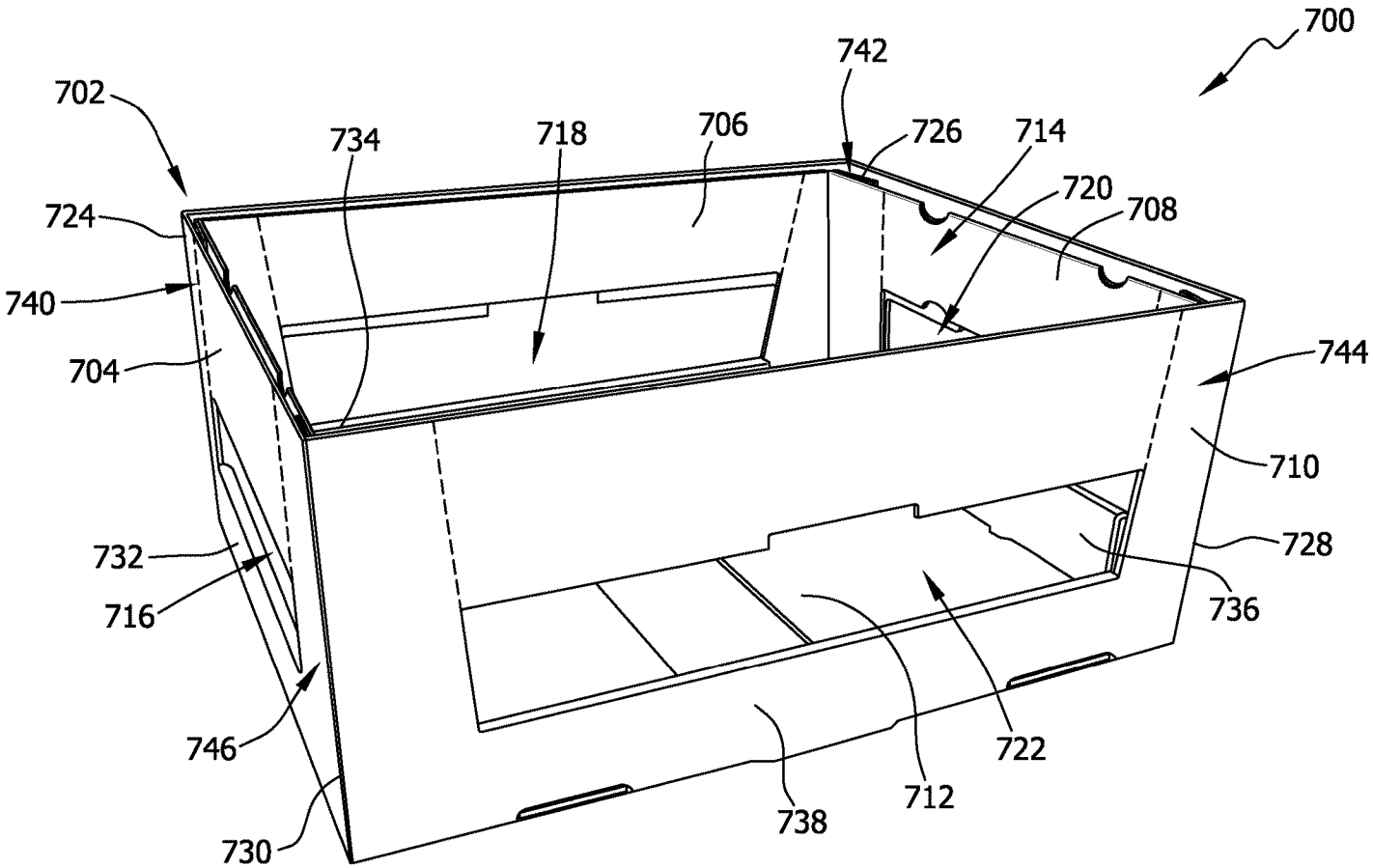
Figure 9:
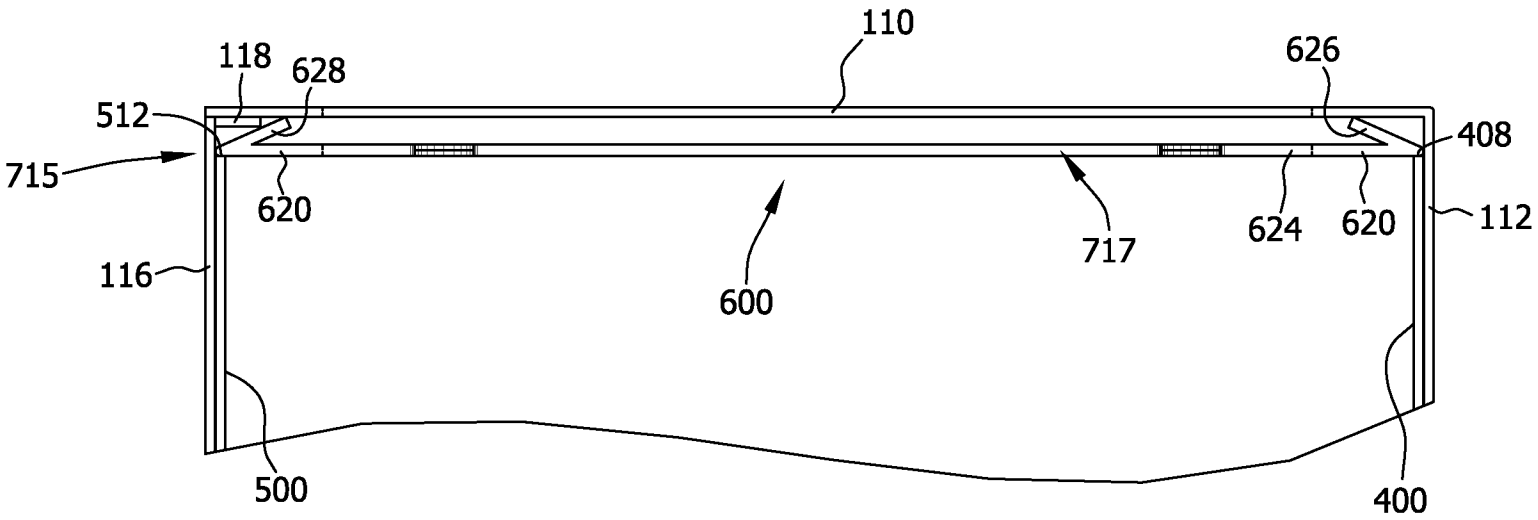
Figure 10:
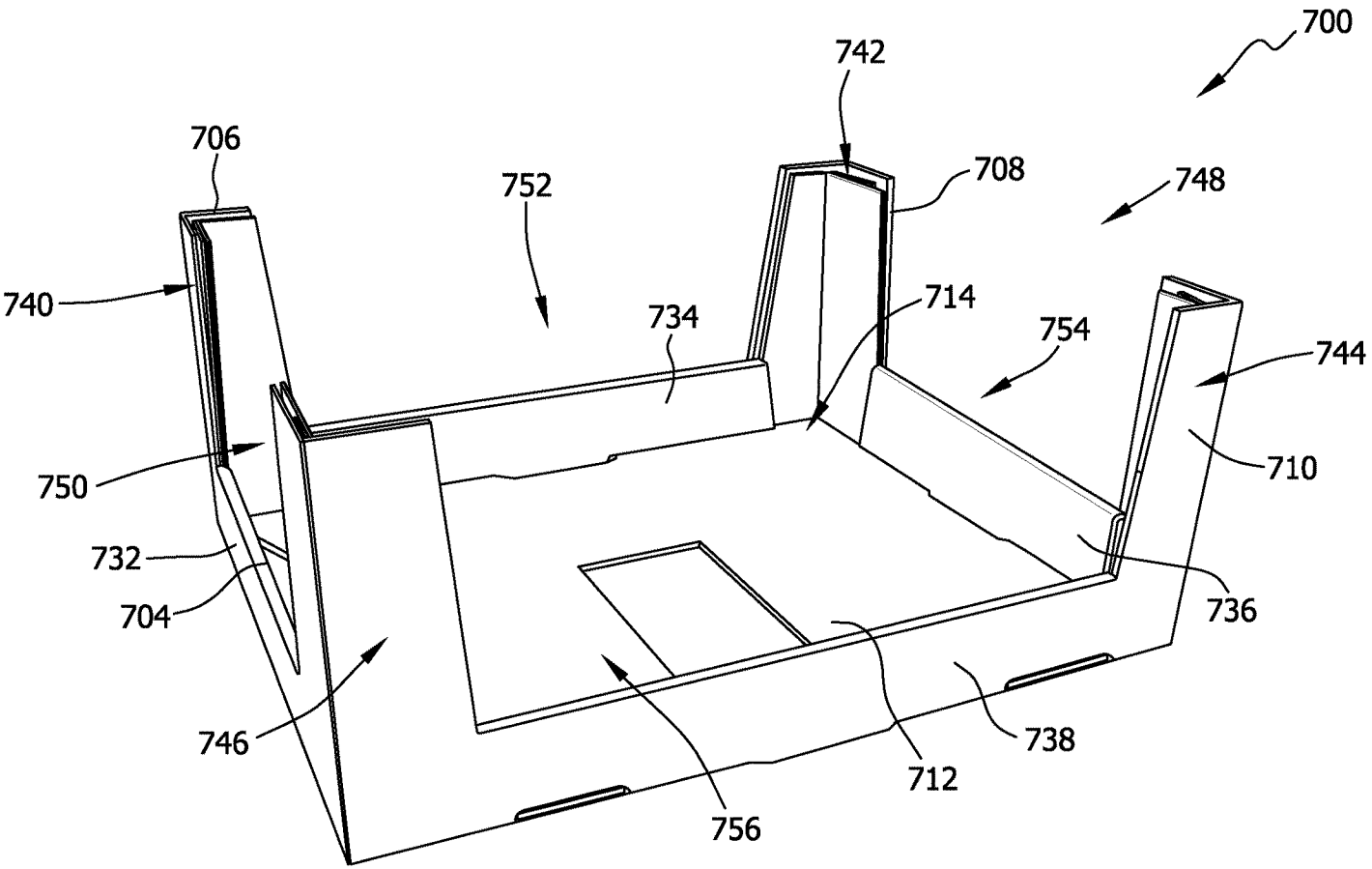

FIG. 2 is a top view of an exemplary first side insert blank 400 of sheet material for forming container 700 (shown in FIGS. 8-10). First side insert blank 400 is configured to be coupled to interior surface 102 (shown in FIG. 1) of first side panel assembly 112 (shown in FIG. 1). Insert blank 400 has a first or interior surface 402 and an opposing second or exterior surface 404. Further, blank 400 includes a free top edge 406, a first free side edge 408, a free bottom edge 410, and a second free side edge 412. In the exemplary embodiment, top edge 406 and bottom edge 410 are substantially parallel to each other, and side edges 408 and 412 are substantially parallel to each other. Side edges 408 and 412 are substantially perpendicular to top edge 406 and bottom edge 410. Angled corners are defined between bottom edge 410 and each side edge 408 and 412. Alternatively, blank 400 includes other than angled corners, such as curved corners, or omits angled corners.

In the exemplary embodiment, blank 400 includes a reinforcing side panel 414, a pad panel 416, cutouts 418 and 420, and a removable tab 422. Cutout 418 is defined by side cut lines 424 and 426, a top cut line 428, and a bottom cut line 430. Top cut line 428 and bottom cut line 430 are substantially parallel to top edge 406 and bottom edge 410. Side cut line 424 is generally perpendicular to bottom cut line 430, but includes a first portion that is oriented at an obtuse angle 432 to bottom cut line 430 such that cutout 418 widens from bottom cut line 430 upwards. A second portion of side cut line 424 angles inwardly toward top cut line 428 such that a largest width of cutout 418 is located at an intersection of the two portions of side cut line 424. The shape of cut line 424 is configured to enable inner side panel 180 (shown in FIG. 1) to be inserted through cutouts 418 and 420 when container 700 is erected. More specifically, the shape provides room for error when positioning insert blank 400 on first side panel assembly 112. Alternatively, cut line 424 has any suitable configuration that enables insert blank 400 to function as described herein. In the exemplary embodiment, cutout 420 is substantially a mirror image of cutout 418 and is defined by side cut lines 424 and 426, top cut line 428, and bottom cut line 430.

Removable tab 422 is defined between cutouts 418 and 420 by cut lines 426. Removable tab 422 is further defined by a slit score line 434 and a perforated line 436. Slit score line 434 is substantially co-linear with cut lines 428, and perforated line 436 is substantially co-linear with cut lines 430. Tab 422 is configured to enable the machine to sense insert blank 400 as insert blank 400 is coupled to tray blank 100. More specifically, a photo eye of the machine senses tab 422 to maintain a count. Further, tab 422 is configured to prevent jamming of the machine as insert blanks 400 and blanks 100 pass through the machine. More specifically, tab 422 facilitates preventing material from being inserted through cutout 418 and/or cutout 420 as the machine couples insert blank 400 to tray blank 100 and/or forms the knocked-down flat container from the assembled blank, as described in more detail below. In an alternative embodiment, tab 422 is omitted and insert blank 400 includes one continuous cutout rather than cutouts 418 and 420.

In the exemplary embodiment, pad panel 416 is defined by cut lines 428 and slit score line 434 along a bottom edge thereof. Pad panel 416 is further defined by tear lines 438 and 440 extending between top edge 406 and cut lines 424. Tear lines 438 and 440 are configured to enable pad panel 416 to be removed from insert blank 400 by a user. More specifically, tear lines 438 and 440 are configured to substantially, or at least partially, align with tear lines 192 and 194 (shown in FIG. 1), respectively, such that pad panel 416 and pad panel 182 (shown in FIG. 1) can be removed together. Indicia 442 can be embossed on pad panel 416 to facilitate assembling blanks 100 and 400 into the formed blank. For example, indicia 442 on pad panel 416 corresponds to indicia 198 (shown in FIG. 1) on pad panel 182 to facilitate coupling insert blank 400 to first side panel assembly 112 for assembling the formed blank.

A bottom portion 444 of reinforcing side panel 414 is at least partially defined by bottom edge 410, cut lines 430, and perforated line 436. A first side portion 446 of reinforcing side panel 414 is at least partially defined by side edge 408, cut line 424, tear line 438, and top edge 406. Similarly, a second side portion 448 of reinforcing side panel 414 is at least partially defined by side edge 412, cut line 424, tear line 440, and top edge 406. Side portions 446 and 448 are continuous with bottom portion 444.

Cutouts 418 and 420, tab 422, and pad panel 416 are symmetric about a centerline 450 thereof. In the exemplary embodiment, centerline 450 of cutouts 418 and 420, tab 422, and pad panel 416 is slightly offset from a centerline 452 of blank 400 toward second side edge 412 of blank 400 to correspond to a shape of first side panel assembly 112 caused by the slight arc of top edges 128, 130, 132, and 134 (all shown in FIG. 1) and bottom fold lines 136, 138, 140, and 142 (all shown in FIG. 1) of tray blank 100. Alternatively, centerline 450 is substantially aligned with centerline 452 or offset toward first side edge 408 of blank 400.

Figure 3:
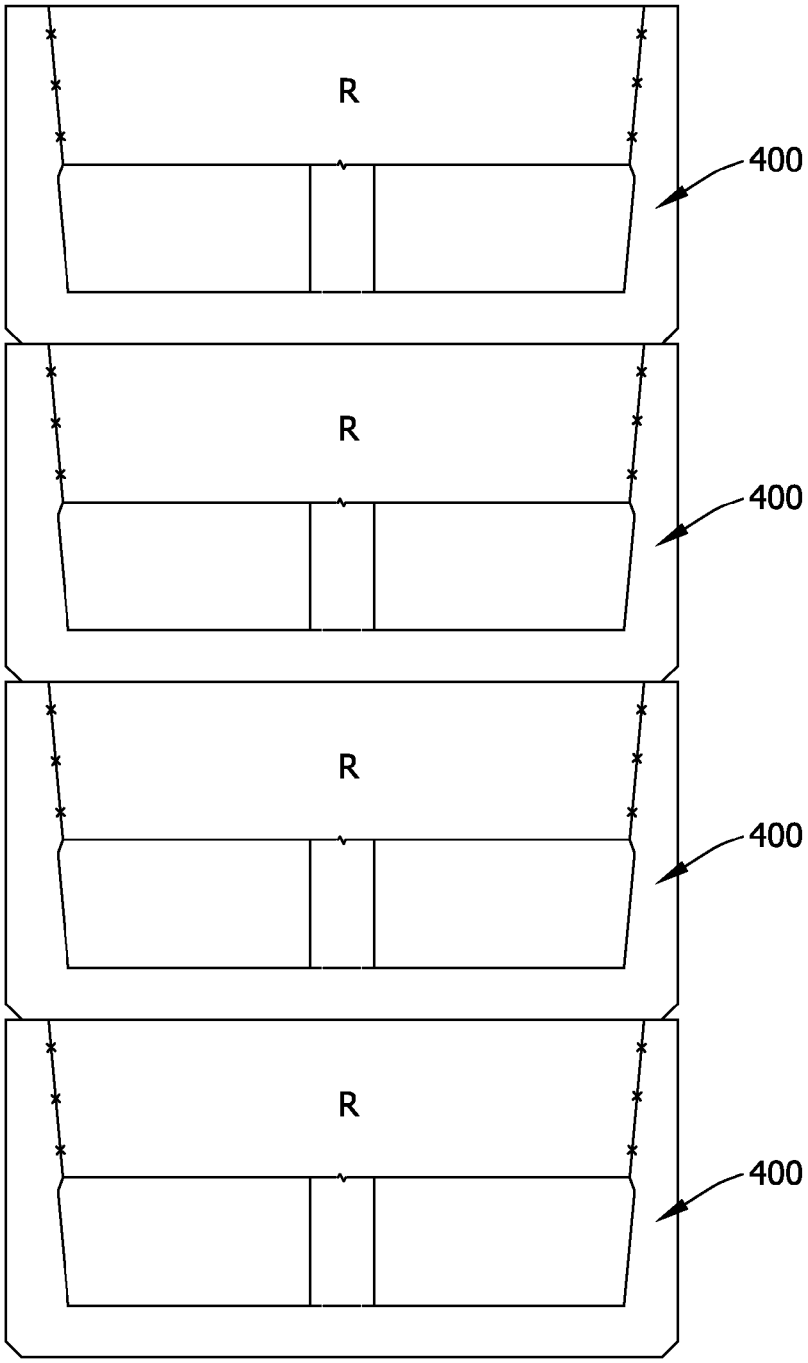

When manufacturing blank 400, a plurality of first side insert blanks 400 can be formed from one sheet of material, as shown in FIG. 3.

Figure 4:
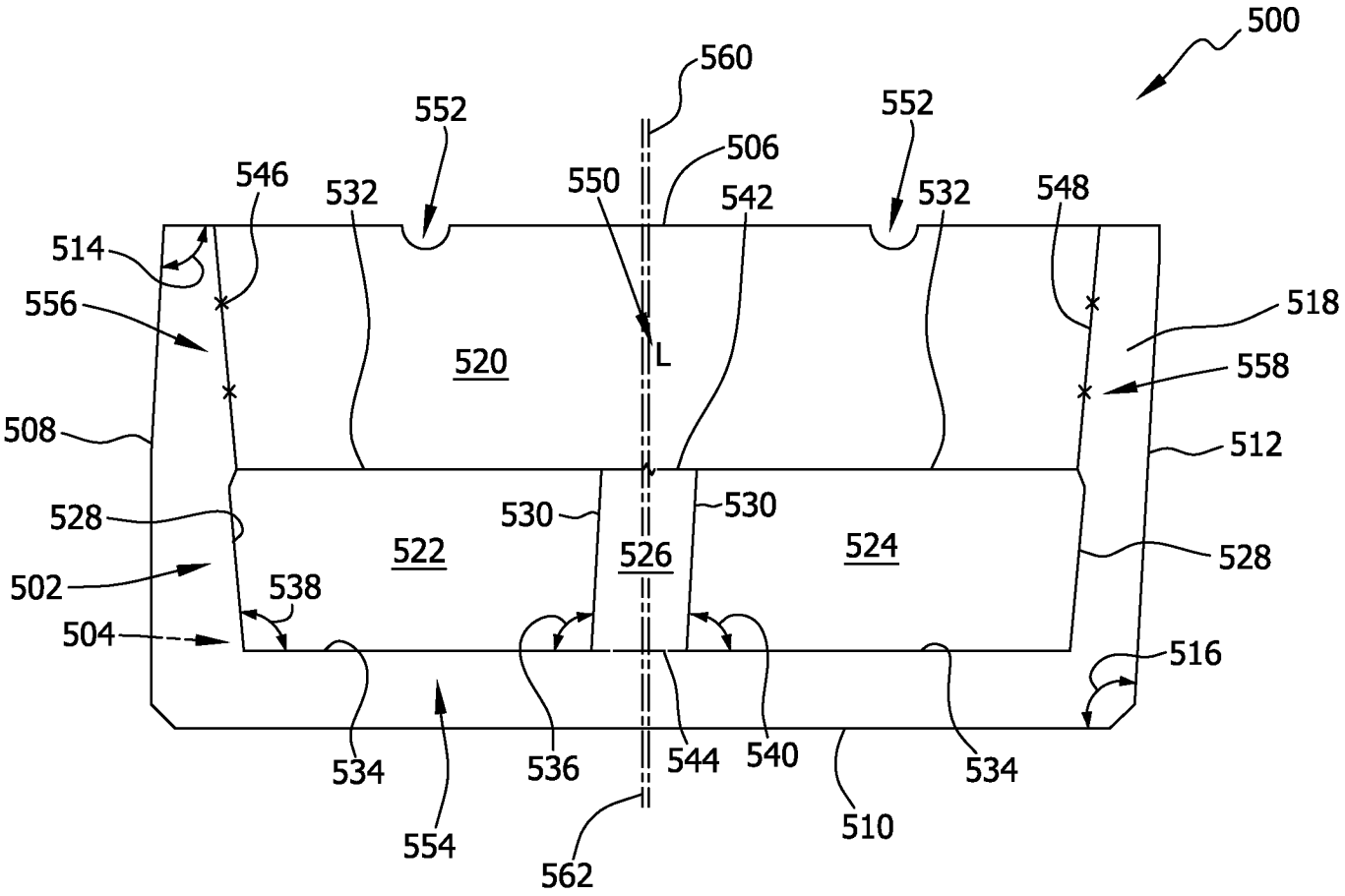

FIG. 4 is a top view of an exemplary second side insert blank 500 of sheet material for forming container 700 (shown in FIGS. 8-10). Second side insert blank 500 is configured to be coupled to interior surface 102 (shown in FIG. 1) of second side panel assembly 116 (shown in FIG. 1). Insert blank 500 has a first or interior surface 502 and an opposing second or exterior surface 504. Further, blank 500 includes a free top edge 506, a first free side edge 508, a free bottom edge 510, and a second free side edge 512. In the exemplary embodiment, top edge 506 and bottom edge 510 are substantially parallel to each other, and side edges 508 and 512 are only partially parallel to each other. More specifically, first side edge 508 includes a first portion that is substantially perpendicular to bottom edge 510 and a second portion that is angled inwardly from the first portion toward second side edge 512. The second portion is connected to top edge 506 at an obtuse angle 514. Second side edge 512 includes a first portion that extends from bottom edge 510 at an obtuse angle 516 and a second portion that connects to top edge 506 at a right angle.

The second portion of side edge 508 and the first portion of side edge 512, i.e., the orthogonal portions, are configured to correspond to the shape of second side panel assembly 116. The first portion of side edge 508 and the second portion of side edge 512, i.e., the perpendicular portions, are configured to enable the machine to properly align insert blank 500 with second side panel assembly 116 even though a longitudinal axis 324 (shown in FIG. 1) of second side panel assembly 116 is not parallel to longitudinal axis 144 (shown in FIG. 1) of tray blank 100. More specifically, longitudinal axis 324 is orthogonal to blank longitudinal axis 144. Additionally, longitudinal axes of first end panel assembly 110 and second end panel assembly 114 are orthogonal to longitudinal axis 144. In an alternative embodiment, the perpendicular portions are omitted from side edges 508 and/or 512 and side edges 508 and/or 512 are orthogonal to edges 506 and/or 510. In the exemplary embodiment, angled corners are defined between bottom edge 510 and each side edge 508 and 512. Alternatively, blank 500 includes other than angled corners, such as curved corners, or omits angled corners.

In the exemplary embodiment, blank 500 includes a reinforcing side panel 518, a pad panel 520, cutouts 522 and 524, and a removable tab 526. Cutout 522 is defined by side cut lines 528 and 530, a top cut line 532, and a bottom cut line 534. Top cut line 532 and bottom cut line 534 are substantially parallel to top edge 506 and bottom edge 510. Side cut line 530 is at an obtuse angle 536 to bottom cut line 534, and side cut line 528 includes a first portion that is oriented at an obtuse angle 538 to bottom cut line 534 such that cutout 522 widens from bottom cut line 534 upwards. A second portion of side cut line 528 angles inwardly toward top cut line 532 such that a largest width of cutout 522 is located at an intersection of the two portions of side cut line 528. The shape of cut line 528 is configured to enable inner side panel 224 (shown in FIG. 1) to be inserted through cutouts 522 and 524 when container 700 is erected. More specifically, the shape provides room for error when positioning insert blank 500 on second side panel assembly 116. Alternatively, cut lines 528 have any suitable configuration that enables insert blank 500 to function as described herein. In the exemplary embodiment, cutout 524 is substantially a mirror image of cutout 522, except for cut line 530, and is defined by side cut lines 528 and 530, top cut line 532, and bottom cut line 534. More specifically, cut line 530 of cutout 524 is substantially parallel to cut line 530 of cutout 522 and is at an acute angle 540 to bottom cut line 534. Alternatively, cut lines 530 have any suitable configuration that enables blank 500 to function as described herein.

Removable tab 526 is defined between cutouts 522 and 524 by cut lines 530. Removable tab 526 is further defined by a slit score line 542 and a perforated line 544. Slit score line 542 is substantially co-linear with cut lines 532, and perforated line 544 is substantially co-linear with cut lines 534. Tab 526 is configured to enable the machine to sense insert blank 500 as insert blank 500 is coupled to tray blank 100. More specifically, the photo eye of the machine senses tab 526 to maintain a count. Further, tab 526 is configured to prevent jamming of the machine as insert blanks 500 and blanks 100 pass through the machine. More specifically, tab 526 facilitates preventing material from being inserted through cutout 522 and/or cutout 524 as the machine couples insert blank 500 to tray blank 100 and/or forms the knocked-down flat container from the assembled blank, as described in more detail below. In an alternative embodiment, tab 526 is omitted and insert blank 500 includes one continuous cutout rather than cutouts 522 and 524.

In the exemplary embodiment, pad panel 520 is defined by cut lines 532 and slit score line 542 along a bottom edge thereof. Pad panel 520 is further defined by tear lines 546 and 548 extending between top edge 506 and cut lines 528 and 532. Tear lines 546 and 548 are configured to enable pad panel 520 to be removed from insert blank 500 by a user. More specifically, tear lines 546 and 548 are configured to substantially, or at least partially, align with tear lines 236 and 238 (shown in FIG. 1), respectively, such that pad panel 520 and pad panel 226 (shown in FIG. 1) can be removed together. Indicia 550 can be embossed on pad panel 520 to facilitate assembling blanks 500 and 100 into the formed blank. For example, indicia 550 on pad panel 520 corresponds to indicia 242 (shown in FIG. 1) on second side panel assembly 116 to facilitate coupling insert blank 500 to second side panel assembly 116 for assembling the formed blank. In the exemplary embodiment, top edge 506 of pad panel 520 includes a pair of notches 552 configured to visually differentiate insert blank 500 from insert blank 400. Alternatively, pad panel 520 does not include notches 552 defined therein.

A bottom portion 554 of reinforcing side panel 518 is at least partially defined by bottom edge 510, cut lines 534, and perforated line 544. A first side portion 556 of reinforcing side panel 518 is at least partially defined by side edge 508, cut line 528, tear line 546, and top edge 506. Similarly, a second side portion 558 of reinforcing side panel 518 is at least partially defined by side edge 512, cut line 528, tear line 548, and top edge 506. Side portions 556 and 558 are continuous with bottom portion 554.

In the exemplary embodiment, a centerline 560 of cutouts 522 and 524, tab 526, and pad panel 520 is slightly offset from a centerline 562 of blank 500 toward second side edge 512 of blank 500 to correspond to a shape of second side panel assembly 116 caused by the slight arc of top edges 128, 130, 132, and 134 (all shown in FIG. 1) and bottom fold lines 136, 138, 140, and 142 (all shown in FIG. 1) of tray blank 100. Alternatively, centerline 560 of is substantially aligned with centerline 562 or offset toward first side edge 508 of blank 500.

Figure 5:
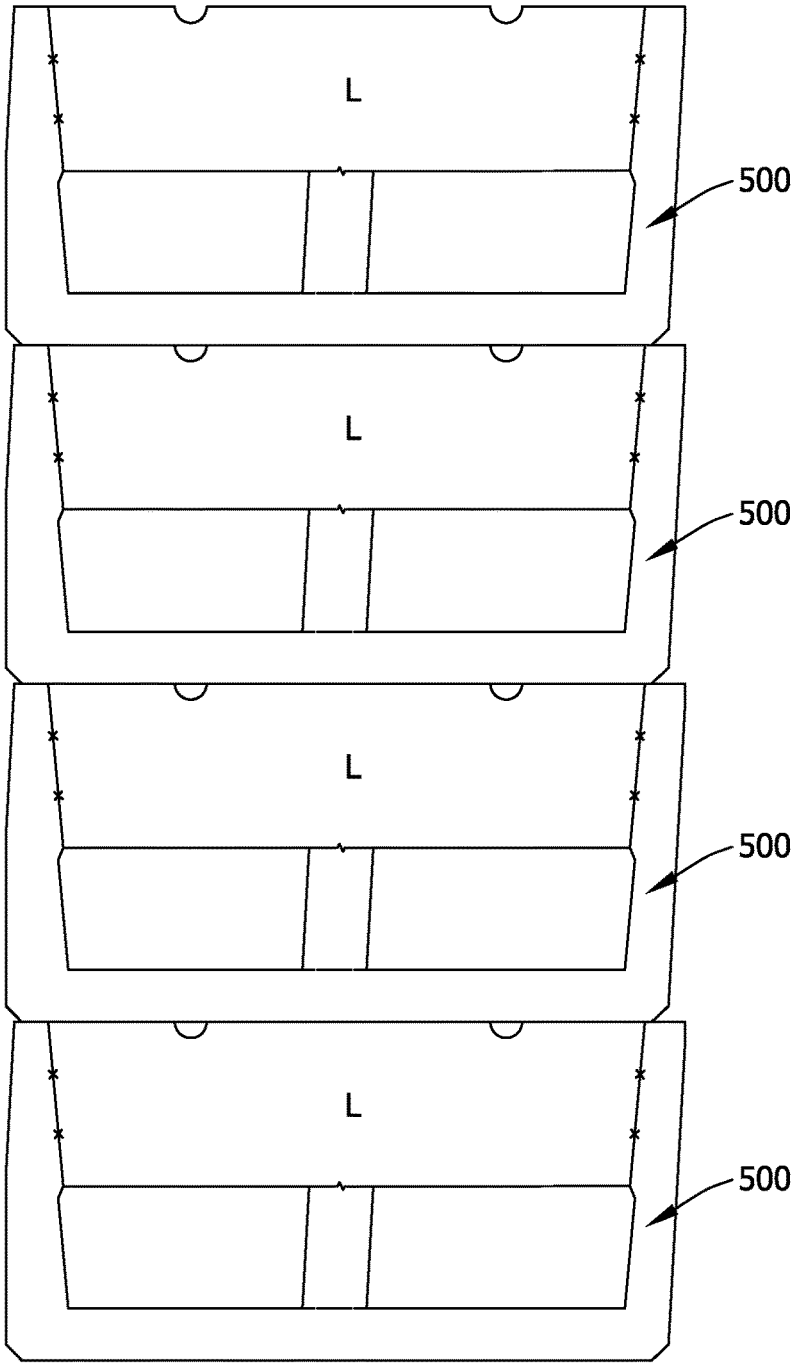

When manufacturing blank 500, a plurality of second side insert blanks 500 can be formed from one sheet of material, as shown in FIG. 5.

Figure 6:
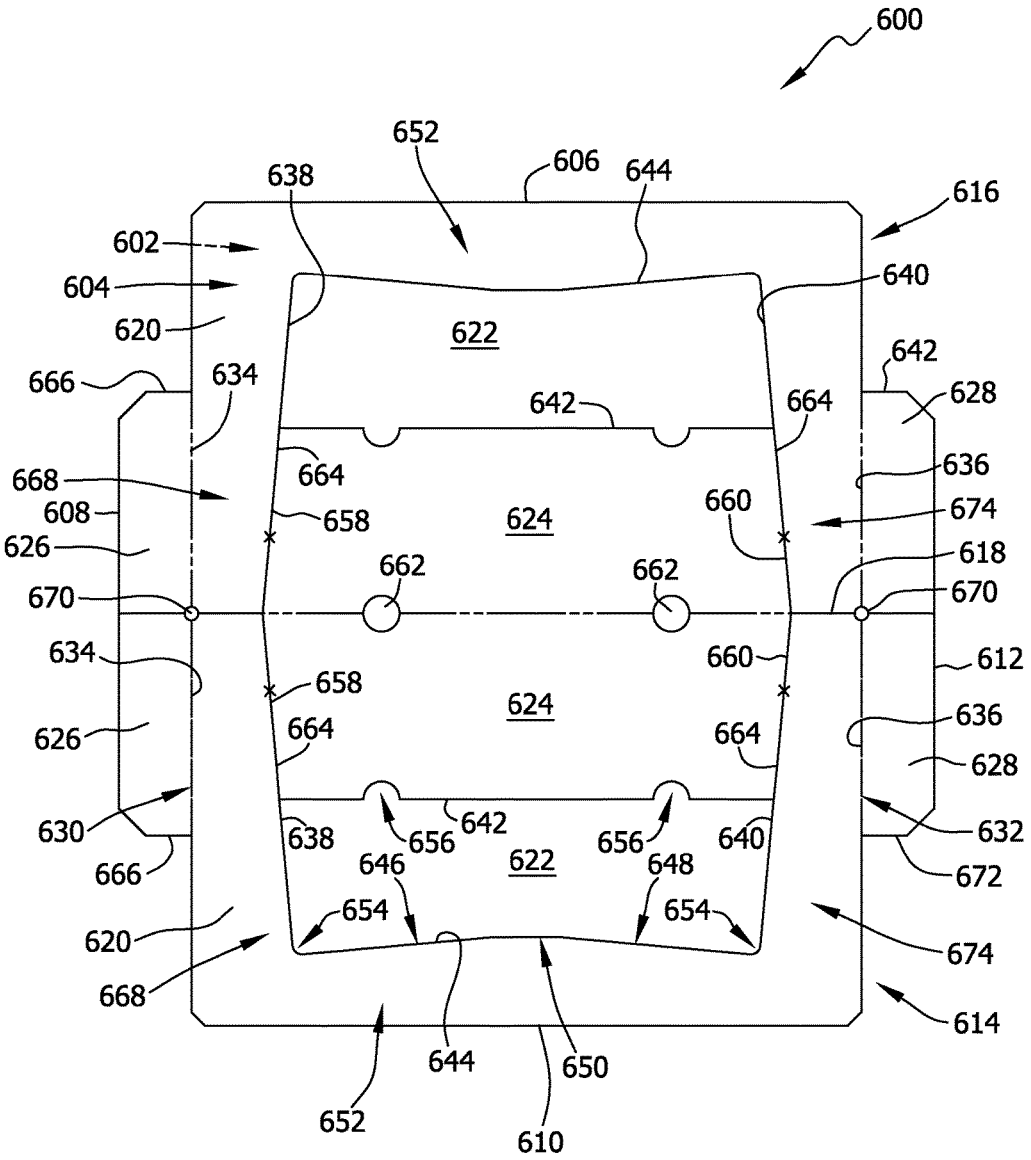

FIG. 6 is a top view of an exemplary end insert blank 600 of sheet material for forming container 700 (shown in FIGS. 8-10). End insert blank 600 is configured to be coupled to, or positioned adjacent, interior surface 102 (shown in FIG. 1) of each end panel assembly 110 and 114 (shown in FIG. 1). Insert blank 600 has a first or interior surface 602 and an opposing second or exterior surface 604. Further, blank 600 includes a free top edge 606, a first free side edge 608, a free bottom edge 610, and a second free side edge 612. A first reinforcing end assembly 614 is partially defined by top edge 606 and side edges 608 and 612, and a second reinforcing end assembly 616 is partially defined by bottom edge 610 and side edges 608 and 612. Reinforcing end assemblies 614 and 616 are symmetric across a fold line 618 that horizontally bisects blank 600. As such, first reinforcing end assembly 614 is described below for clarity; however, it should be understood that the description also applies to second reinforcing end assembly 616.

First reinforcing end assembly 614 includes a reinforcing end panel 620 having a cutout 622 and a pad panel 624 defined therein and having a stacking flap 626 or 628 extending from each side edge 630 and 632 thereof A fold line 634 or 636 partially defines side edge 630 and 632, respectively, of reinforcing end panel 620. In the exemplary embodiment, cutout 622 is defined by a pair of side cut lines 638 and 640, a top cut line 642, and a bottom cut line 644. Side cut lines 638 and 640 diverge from each other from bottom cut line 644 to top cut line 642 such that a shape of cutout 622 generally corresponds to a shape of inner end panel 160 and/or 204 (shown in FIG. 1). Bottom cut line 644 includes two downwardly sloping portions 646 and 648 and a substantially horizontal portion 650. Downwardly sloping portions 646 and 648 are configured to narrow a bottom portion 652 of reinforcing end panel 620 adjacent side cut lines 638 and 640. Such narrowing of bottom portion 652 removes material from lower corners 654 of cutout 622 to enable inner end panel 160 or 204 to be folded over bottom portions 652 when container 700 is erected and to reduce stress on inner end panel 160 or 204 when inner end panel 160 or 204 is folded over, as described in more detail below. Top cut line 642 defines a pair of notches 656 configured to facilitate a user's removable of pad panels 624 from end insert 1012 (shown in FIG. 13A), as described in more detail below.

Pad panel 624 is defined by top cut line 642, a pair of tear lines 658 and 660, and fold line 618. Pad panels 624 are connected at fold line 618, and fold line 618 includes a pair of cutouts 662 that are configured to facilitate a user's removable of pad panels 624 from container 700. Tear lines 658 and 660 extend between fold line 618 and a respective cut line 638 or 640. Tear lines 658 and 660 are configured to enable pad panel 624 to be removed from insert blank 600 by a user. In a particular embodiment, tear lines 658 and 660 each include a cut portion 664 that extends from cut line 638 or 640. In the exemplary embodiment, tear lines 658 and 660 are configured to substantially, or at least partially, align with tear lines 172 and 174 (shown in FIG. 1), respectively, or tear lines 216 and 218 (shown in FIG. 1), respectively, such that pad panels 624 and pad panel 162 (shown in FIG. 1) or pad panels 624 and pad panel 206 (shown in FIG. 1) can be removed together.

A first stacking flap 626 extends from fold line 634 to side edge 608. First stacking flap 626 is further defined by fold line 618 and a free bottom edge 666. First stacking flap 626 has a width at fold line 618 that is approximately equal to a width of a first side portion 668 of reinforcing end panel 620 such that, when folded 180° about fold line 634, first stacking flap 626 does not overlap pad panel 624 and/or cutout 622. First stacking flap 626 of first reinforcing end assembly 614 is connected to first stacking flap 626 of second reinforcing end assembly 616 along fold line 618. A relief cutout 670 is defined at the intersection of fold line 618 and fold lines 634 to facilitate rotating stacking flaps 626 about fold lines 634, as described in more detail below.

A second stacking flap 628 extends from fold line 636 to side edge 612. Second stacking flap 628 is further defined by fold line 618 and a free bottom edge 672. Second stacking flap 628 has a width at fold line 618 that is approximately equal to a width of a second side portion 674 of reinforcing end panel 620 such that, when folded 180° about fold line 636, second stacking flap 628 does not overlap pad panel 624 and/or cutout 622. Second stacking flap 628 of first reinforcing end assembly 614 is connected to second stacking flap 628 of second reinforcing end assembly 616 along fold line 618. Relief cutout 670 is defined at the intersection of fold line 618 and fold lines 636 to facilitate rotating stacking flaps 628 about fold lines 636, as described in more detail below.

First side portion 668 of reinforcing end panel 620 is at least partially defined by side edge 608, cut line 638, tear line 658, fold line 634, and fold line 618. Similarly, second side portion 674 of reinforcing end panel 620 is at least partially defined by side edge 612, cut line 640, tear line 660, fold line 636, and fold line 618. Side portions 668 and 674 are continuous with bottom portion 652.

Figure 7:
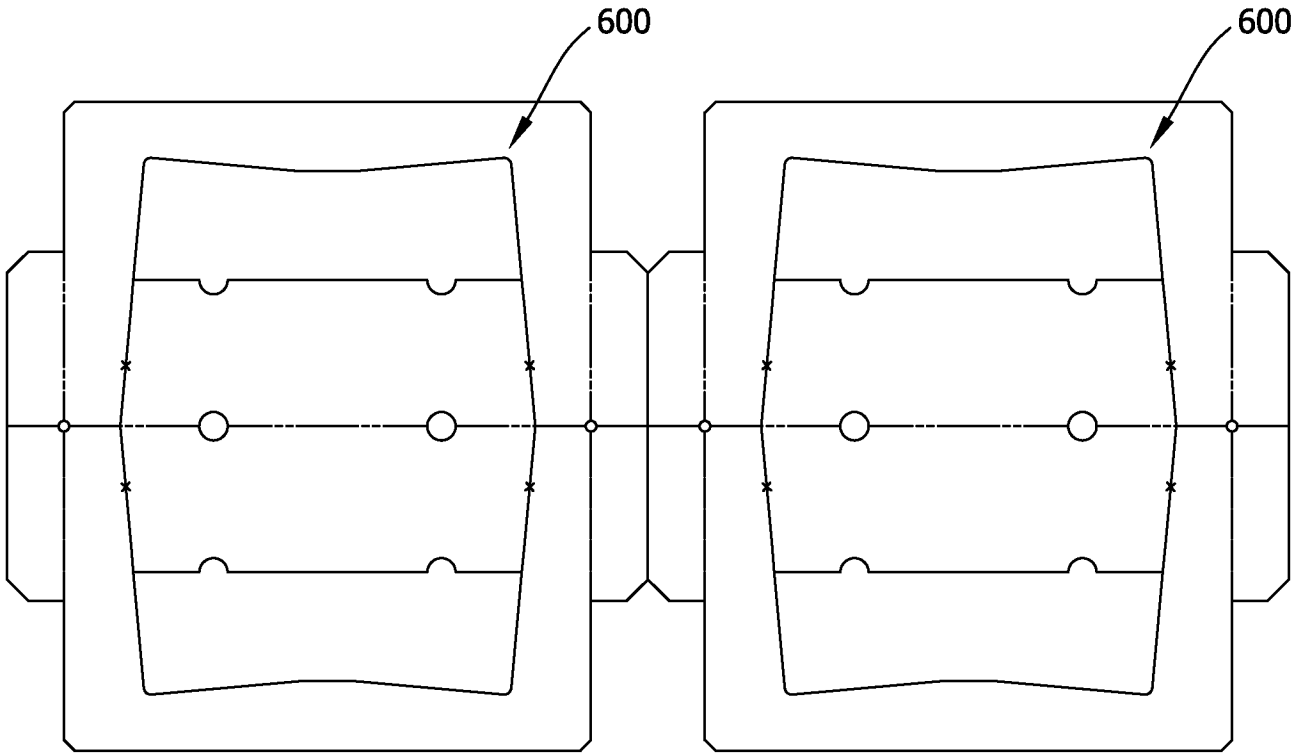

When manufacturing end insert blank 600, a plurality of end insert blanks 600 can be formed from one sheet of material, as shown in FIG. 7.

FIG. 8 is a perspective view of an exemplary tray container 700 formed a blank assembly shown in FIGS. 1-7. FIG. 9 is a top view of an end portion of container 700. The blank assembly includes tray blank 100 (shown in FIG. 1), first side insert blank 400 (shown in FIG. 2), second side insert blank 500 (shown in FIG. 4), and a pair end insert blanks 600 (shown in FIG. 6). Container 700 is shown in an erect configuration 702 in FIG. 8. Referring to FIGS. 1, 2, 4, 6, and 8, container 700 includes a first end wall 704, a first side wall 706, a second end wall 708, a second side wall 710, and a bottom wall 712 that define a cavity 714 of container 700.

First end wall 704 includes first end panel assembly 110, glue panel 118, and a first end insert blank 600. A first end window 716 is defined in first end wall 704 by cutouts 622 of end insert blank 600 and an opening formed by folding inner end panel 160 over bottom portions 652 of reinforcing end panel 620, as described in more detail below. In erect configuration 702, end wall 704 includes end panels 158 and 620 and glue panel 118, and pad panels 162 and pad panels 624 are included in first end wall 704. First end wall 704 further includes a ledge 715 defined by a top edge 717 of pad panels 624, reinforcing end panels 620, and stacking flaps 626 and 628 formed by fold line 618. More specifically, stacking flaps 626 and 628 bias reinforcing end panels 620 and pad panels 624 away from interior surface 102 of first end panel assembly 110 toward cavity 714. However, inner end panel 160 being wrapped about bottom portions 652 and/or free side edges 408 and 512 of side inserts 400 and 500, respectively, force reinforcing end panels 620 and pad panels 624 toward first end panel assembly 110. As such, reinforcing end panels 620 and pad panels 624 are substantially perpendicular to bottom wall 712 while first end panel assembly 110 is at an obtuse angle with respect to bottom wall 712. Accordingly, cavity 714 is a substantially rectangular prism, rather than having the shape of an inverted truncated pyramid.

First side wall 706 includes first side panel assembly 112 and first side insert blank 400. A first side window 718 is defined in first side wall 706 by cutouts 418 and 420 of insert blank 400, a opening formed by removing tab 422 from insert blank 400, and an opening formed by folding inner side panel 180 over bottom portion 444 of reinforcing side panel 414, as described in more detail below. In erect configuration 702, side wall 706 includes side panels 178 and 414, and pad panels 182 and 416 are included in first side wall 706.

Second end wall 708 includes second end panel assembly 114 and a second end insert blank 600. A second end window 720 is defined in second end wall 708 by cutouts 622 of end insert blank 600 and an opening formed by folding inner end panel 204 over bottom portions 652 of reinforcing end panel 620, as described in more detail below. In erect configuration 702, end wall 708 includes end panels 202 and 620, and pad panels 206 and pad panels 624 are included in second end wall 708. Second end wall 708 further includes a ledge (not shown). The ledge is similar to ledge 715 and is defined by top edge 717 of pad panels 624, reinforcing end panels 620, and stacking flaps 626 and 628 formed by fold line 618. More specifically, stacking flaps 626 and 628 bias reinforcing end panels 620 and pad panels 624 away from interior surface 102 of second end panel assembly 114 toward cavity 714. However, inner end panel 204 being wrapped about bottom portions 652 and/or free side edges 412 and 508 of side inserts 400 and 500, respectively, force reinforcing end panels 620 and pad panels 624 toward second end panel assembly 114. As such, reinforcing end panels 620 and pad panels 624 are substantially perpendicular to bottom wall 712 while second end panel assembly 114 is at an obtuse angle with respect to bottom wall 712. Accordingly, cavity 714 is a substantially rectangular prism, rather than having the shape of an inverted truncated pyramid.

Second side wall 710 includes second side panel assembly 116 and second side insert blank 500. A second side window 722 is defined in second side wall 710 by cutouts 522 and 524 of insert blank 500, a opening formed by removing tab 526 from insert blank 500, and an opening formed by folding inner side panel 224 over bottom portion 554 of reinforcing side panel 518, as described in more detail below. In erect configuration 702, side wall 710 includes side panels 222 and 518, and pad panels 226 and 520 are included in second side wall 710. A first corner 724 is defined between first end wall 704 and first side wall 706, a second corner 726 is defined between first side wall 706 and second end wall 708, a third corner 728 is defined between second end wall 708 and second side wall 710, and a fourth corner 730 is defined between second side wall 710 and first end wall 704.

A bottom portion of first end panel 158, bottom portions 652 of reinforcing end panel 620, and inner end panel 160 define a first end lip 732 of container 700. A bottom portion of first side panel 178, bottom portion 444 of reinforcing side panel 414, and inner side panel 180 define a first side lip 734 of container 700. A bottom portion of second end panel 202, bottom portions 652 of reinforcing end panel 620, and inner end panel 204 define a second end lip 736 of container 700. A bottom portion of second side panel 222, bottom portion 554 of reinforcing side panel 518, and inner side panel 224 define a second side lip 738 of container 700.

A side portion of first end panel 158, a side portion of first side panel 178, side portions 668 of reinforcing end panels 620, stacking flaps 626, and side portion 446 of reinforcing side panel 414 form a first column 740. A side portion of first side panel 178, a side portion of second end panel 202, side portion 448 of reinforcing side panel 414, stacking flaps 628, and side portions 674 of reinforcing end panels 620 form a second column 742. A side portion of second end panel 202, a side portion of second side panel 222, side portions 668 of reinforcing end panels 620, stacking flaps 626, and side portion 556 of reinforcing side panel 518 form a third column 744. A side portion of second side panel 222, a side portion of first end panel 158, glue panel 118, side portion 558 of reinforcing side panel 518, stacking flaps 628, and side portions 674 of reinforcing end panels 620 form a fourth column 746. First column 740 includes first corner 724, second column 742 includes second corner 726, third column 744 includes third corner 728, and fourth column 746 includes fourth corner 730. First end lip 732 extends between first column 740 and fourth column 746, first side lip 734 extends between first column 740 and second column 742, second end lip 736 extends between second column 742 and third column 744, and second side lip 738 extends between third column 744 and fourth column 746.

Bottom wall 712 includes first bottom end panel assembly 150, first side bottom panel 152, second bottom end panel 154, and second bottom side panel assembly 156. In the exemplary embodiment, coupling panel 250 is coupled to first bottom side panel 152 and coupling panel 302 is coupled to second bottom end panel 154, as described in more detail below. Bottom wall 712 is configured to fold upward into cavity 714 to transition container 700 to the knocked-down flat configuration and rotate downward to transition container 700 to erect configuration 702.

FIG. 10 is a perspective view of container 700 in a display configuration 748. Referring to FIGS. 1, 2, 4, 6, and 10, in display configuration 748, pad panel 162 and pad panels 624 are removed from first end wall 704 at tear lines 172, 174, 658, and 660, pad panels 182 and 416 are removed from first side wall 706 at tear lines 192, 194, 438, and 440, pad panel 206 and pad panels 624 are removed from second end wall 708 at tear lines 216, 218, 658, and 660, and pad panels 226 and 520 are removed from second side wall 710 at tear lines 236, 238, 546, and 548. As such, each wall 704, 706, 708, and 710 includes a respective access opening 750, 752, 754, or 756 that is larger than windows 716, 718, 720, and/or 722 (all shown in FIG. 8). Corner columns 740, 742, 744, and 746 remain at each corner of container 700, and lips 732, 734, 736, and 738 remain adjacent bottom wall 712. Corner columns 740, 742, 744, and 746 are configured to allow a second container 700 to be partially nested within container 700 and to support the second container thereon.

Figure 11:
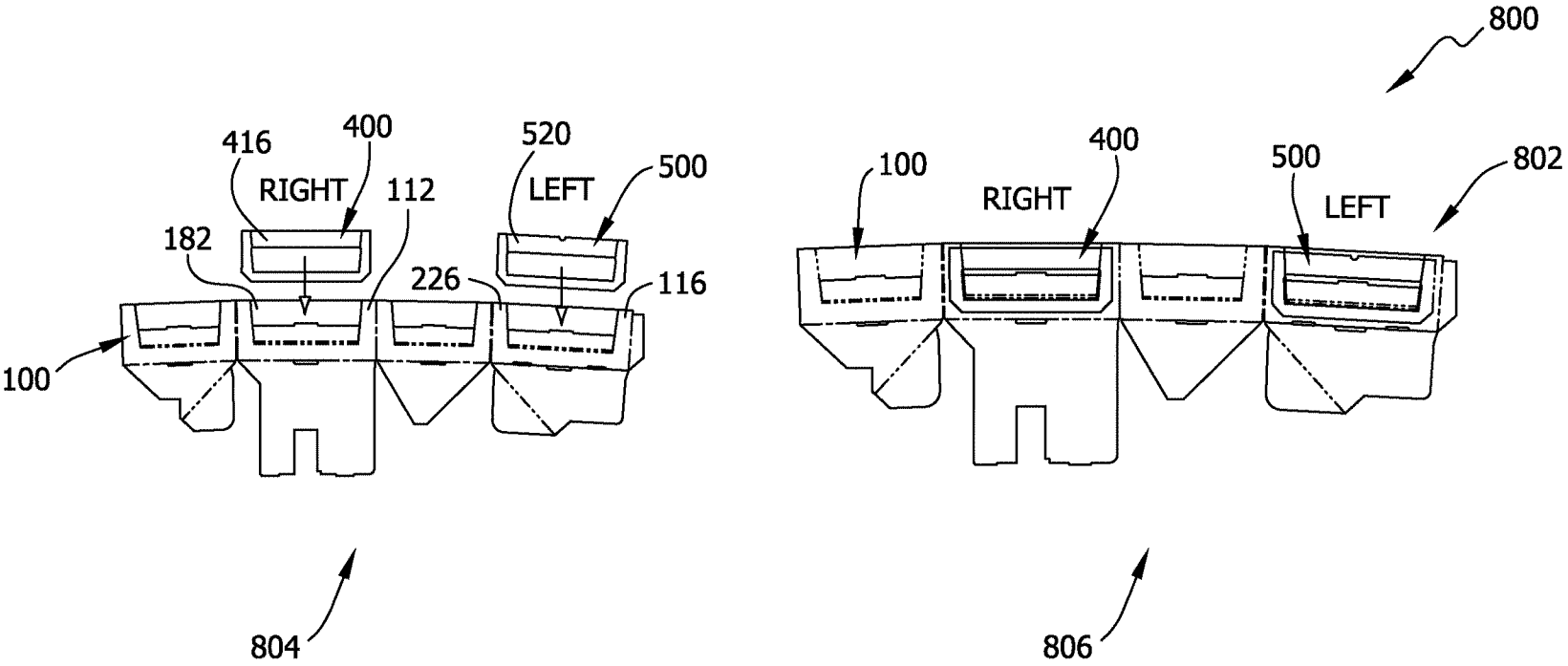

FIG. 11 is a schematic view of an exemplary method 800 for assembling blanks 100, 400, and 500 (shown in FIGS. 1-5) into a formed or assembled blank 802. In a particular embodiment, method 800 is performed using a machine, such as a TANABE™ TRI FEEDER™ machine manufactured by Alliance Machine Systems International, LLC ("Tanabe" and "Tri Feeder" are trademarks of Alliance Machine Systems International, LLC of Spokane, Wash., USA). As discussed above, several features of blanks 100, 400, and/or 500 enable the machine to properly align blanks with each other and glue blanks to each other.

Referring to FIGS. 1, 2, 4, and 11, method 800 includes positioning 804 side insert blanks 400 and 500 with respect to tray blank 100. More specifically, first side insert blank 400 is positioned with respect to first side panel assembly 112 such that pad panel 416 is substantially, or at least partially, aligned with pad panel 182. As such, tear lines 438 and 440 are substantially, or at least partially, aligned with tear lines 192 and 194, respectively, and inner side panel 180 is substantially, or at least partially, aligned with cutouts 418 and 420 and tab 422. Similarly, second side insert blank 500 is positioned with respect to second side panel assembly 116 such that pad panel 520 is substantially, or at least partially, aligned with pad panel 226. As such, tear lines 546 and 548 are substantially, or at least partially, aligned with tear lines 236 and 238, respectively, and inner side panel 224 is substantially, or at least partially, aligned with cutouts 522 and 524 and tab 526. Alignment marks 200 and/or 244 can be used to facilitate aligning insert blanks 400 and/or 500 with a respective side panel assembly 112 or 116.

Insert blanks 400 and 500 are then coupled 806 to tray blank 100. More specifically, exterior surface 404 of first insert blank 400 is coupled to interior surface 102 of first side panel assembly 112 using, for example, an adhesive. In the exemplary embodiment, reinforcing side panel 414 is coupled to first side panel 178 and pad panel 416 is coupled to pad panel 182. Similarly, exterior surface 504 of second insert blank 500 is coupled to interior surface 102 of tray blank 100 using, for example, an adhesive. More specifically, reinforcing side panel 518 is coupled to second side panel 222 and pad panel 520 is coupled to pad panel 226. Assembled blank 802 can then be formed into a knocked-down flat container 902 (shown in FIG. 12).

Figure 12:
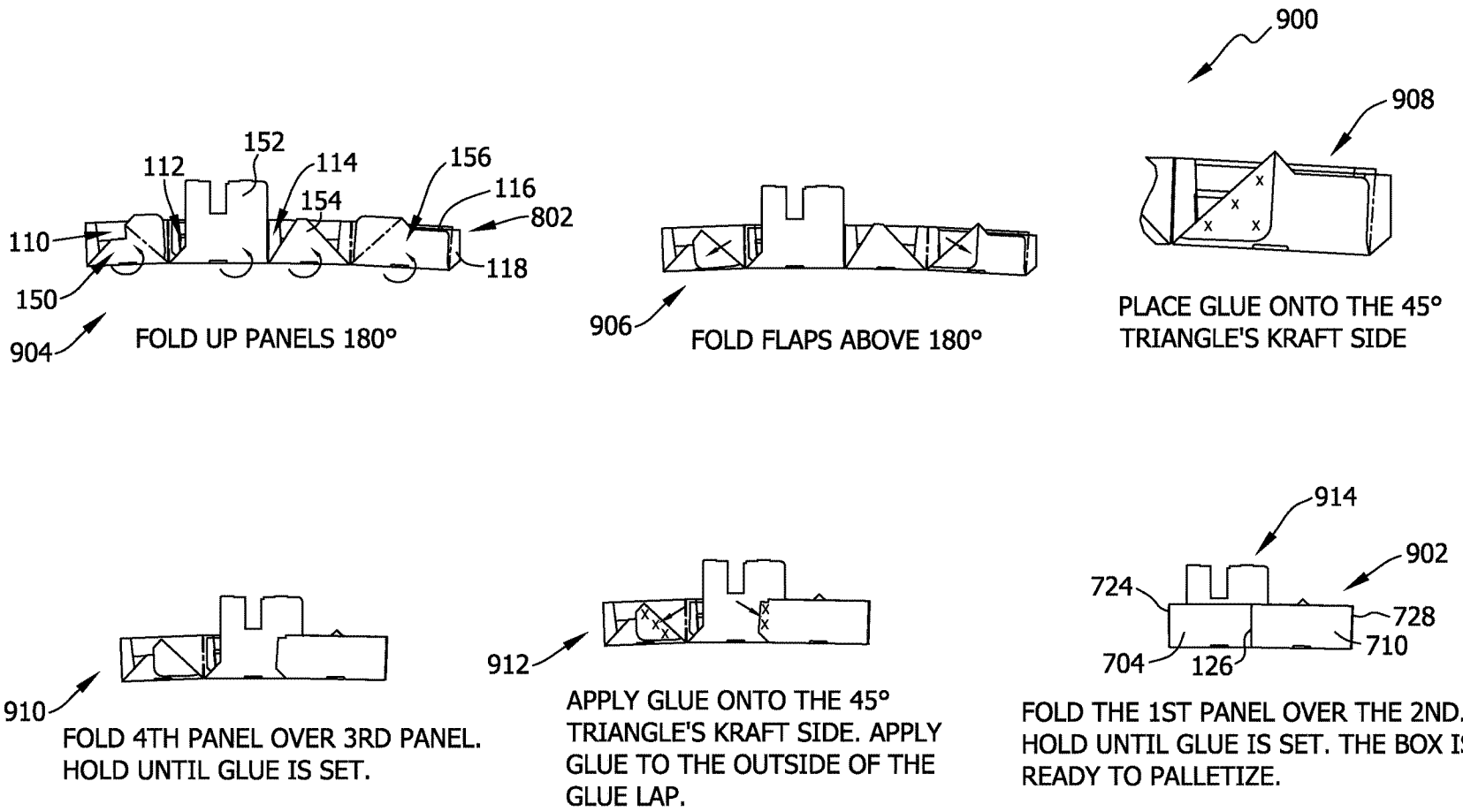

FIG. 12 is a schematic view of an exemplary method 900 for forming a knocked-down flat container 902 from assembled blank 802 (shown in FIG. 11). Knocked-down flat container 902 is similar to container 700 (shown in FIGS. 8-10) in the knocked-down flat configuration. However, in FIG. 12, windows 718, 720, 722, and 724 (all shown in FIG. 8) and/or access openings 750, 752, 754, and 756 (all shown in FIG. 10) have not yet been formed in knocked-down flat container 902. Rather, windows 718, 720, 722, and 724 and/or access openings 750, 752, 754, and 756 are formed in a subsequent erecting method. Method 900 can be performed by a folder gluer machine positioned downstream from the machine used to form assembled blank 802. For example, the folder gluer machine can be a J&L Specialty Folder Gluer manufactured by Alliance Machine Systems International, LLC. Features of blanks 100, 400, and 500 described above facilitate preventing jamming and/or misalignment as the folder gluer machine forms knocked-down flat container 902 from assembled blank 802.

Referring to FIGS. 1, 2, 4, and 12, method 900 includes rotating 904 bottom panels 248, 152, 154, and 300 toward a respective panel assembly 110, 112, 114, or 116. More specifically, first bottom end panel assembly 150 is rotated 904 about fold line 136 toward first end panel assembly 110 such that interior surface 102 of first bottom end panel assembly 150 is adjacent interior surface 102 of first end panel assembly 110. First bottom side panel 152 is rotated 904 about fold line 138 toward first side panel assembly 112 such that interior surface 102 of first bottom side panel 152 is adjacent interior surface 402 of first insert blank 400. Second bottom end panel 154 is rotated 904 about fold line 140 toward second end panel assembly 114 such that interior surface 102 of second bottom end panel 154 is adjacent interior surface 102 of second end panel assembly 114. Second bottom side panel assembly 156 is rotated 904 about fold line 142 toward second side panel assembly 116 such that interior surface 102 of second bottom side panel assembly 156 is adjacent interior surface 502 of second insert blank 500. In an alternative embodiment, first bottom end panel assembly 150 is rotated toward first end panel assembly 110 after coupling panel 302 is coupled to second bottom end panel 154.

In the exemplary embodiment, coupling panel 250 is rotated 906 about fold line 252 toward first bottom end panel 248 such that exterior surface 104 of coupling panel 250 is adjacent exterior surface 104 of first bottom end panel 248. Similarly, coupling panel 302 is rotated 906 about fold line 304 toward second bottom side panel 300 such that exterior surface 104 of coupling panel 302 is adjacent exterior surface 104 of second bottom side panel 300. Alternatively, coupling panel 250 is rotated 906 about fold line 252 after coupling panel 302 is coupled to second bottom end panel 154.

In the exemplary embodiment, adhesive is applied 908 to interior surface 102 of coupling panel 302 and/or to exterior surface 104 of second bottom end panel 154. Second side panel assembly 116 and second bottom side panel assembly 156 are rotated 910 about fold line 124 toward second bottom end panel 154 to couple coupling panel 302 to second bottom end panel 154. More specifically, the adhesive on interior surface 102 of coupling panel 302 contacts exterior surface 104 of second bottom end panel 154 as panel assemblies 116 and 156 are rotated 910 about fold line 124. As such, interior surface 102 of coupling panel 302 is coupled to exterior surface 104 of second bottom end panel 154. Panel assemblies 116 and 156 can be held and/or pressed in position until the adhesive sets.

Adhesive is applied 912 to interior surface 102 of coupling panel 250 and/or to exterior surface 104 of first bottom side panel 152. Adhesive is also applied 912 to exterior surface 104 of glue panel 118 and/or interior surface 102 of first end panel 158. First end panel assembly 110 and first bottom end panel assembly 150 are rotated 914 about fold line 120 toward first bottom side panel 152 to couple coupling panel 250 to first bottom side panel 152 and to couple glue panel 118 to first end panel 158. More specifically, the adhesive on interior surface 102 of coupling panel 250 contacts exterior surface 104 of first bottom side panel 152 and the adhesive on exterior surface 104 of glue panel 118 contacts interior surface 102 of first end panel 158 as panel assemblies 110 and 150 are rotated 914 about fold line 120. As such, interior surface 102 of coupling panel 250 is coupled to exterior surface 104 of first bottom side panel 152, and exterior surface 104 of glue panel 118 is coupled to interior surface 102 of first end panel 158. Panel assemblies 110 and 150 can be held and/or pressed in position until the adhesive sets.

Knocked-down flat container 902 formed using method 900 includes first end wall 704, first side wall 706, second end wall 708, and second side wall 710. Bottom wall 712 is collapsed and received within walls 704, 706, 708, and 710. First corner 724 and third corner 728 are formed at fold lines 120 and 124, respectively, and second corner 726 (shown in FIG. 8) and fourth corner 730 (shown in FIG. 8) are not yet formed. Knocked-down flat container 902 can be shipped, stored, and/or erected into container 700.

Figure 13B:
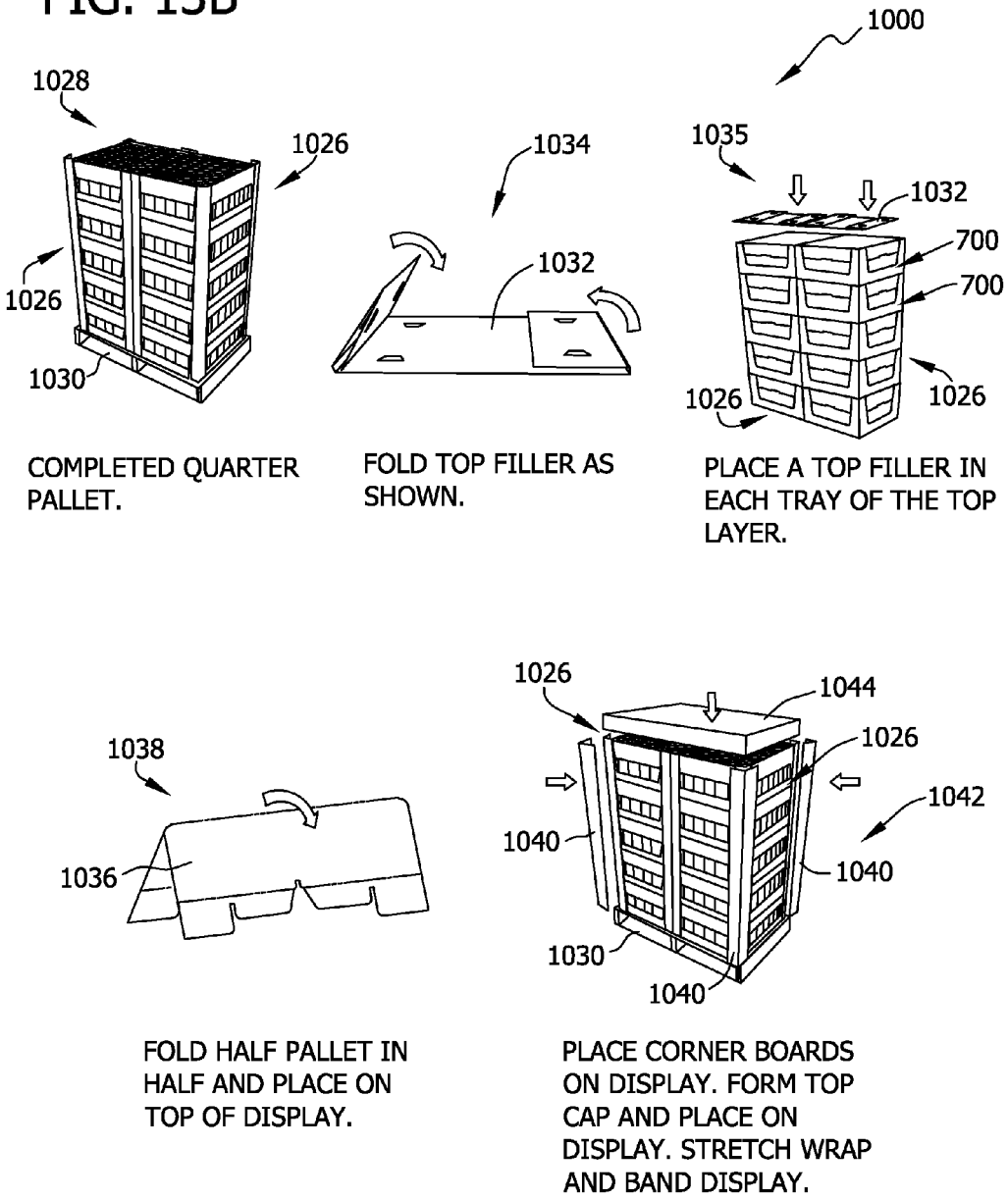

FIGS. 13A and 13B are a schematic view of an exemplary method 1000 for erecting and stacking container 700 (shown in FIG. 8) from knocked-down flat container 902 (shown in FIG. 12). Method 1000 can be performed manually by, for example, a customer that has obtained knocked-down flat container 902. As such, a machine is not required to erect container 700 from knocked-down flat container 902.

Referring to FIGS. 1, 2, 4, 6, 8, 9, 13A, and 13B, method 1000 includes forcing 1002 first corner 724 toward third corner 728. As corners 724 and 728 are forced 1002 toward each other, second corner 726 and fourth corner 730 begin forming at fold lines 122 and 126 and bottom panels 248, 152, 154, and 300 begin to rotate downward away from interior surfaces 102 of walls 704, 706, 708, and 710.

Bottom panels 248, 152, 154, and 300 are then forced 1004 downwardly about fold lines 136, 138, 140, and 142, respectively, to form bottom wall 712. More specifically, tabs 278 are inserted into slots 296 and 298 to secure first bottom side panel 152 over other bottom panels 150, 154, and 156 such that bottom wall 712 is secured in position. Bottom wall 712 is generally perpendicular to walls 704, 706, 708, and 710. Cavity 714 of container 700 is formed, and container 700 can be filled with products 1006; however, in the exemplary embodiment, windows 716, 718, 720, and 722 are defined in walls 704, 706, 708, and 710, respectively, before products 1006 are positioned 1022 within cavity 714.

In the exemplary embodiment, inner side panels 180 and 224 are rotated toward cavity 714 to define 1008 windows 718 and 722 in side walls 706 and 710, respectively. More specifically, first inner side panel 180 is rotated about hinge line 184 toward cavity 714 through cutouts 418 and 420. At least a bottom edge of removable tab 422 is separated from reinforcing side panel 414 at perforated line 436 to allow inner side panel 180 to be rotated through cutouts 418 and 420. Removable tab 422 can be removed before, during, or after inner side panel 180 is rotated through cutouts 418 and 420. In the exemplary embodiment, removable tab 422 is removed as inner side panel 180 is rotated. Alternatively, removable tab 422 is removed when container 700 is transitioned from erect configuration 702 to display configuration 748 (shown in FIG. 10). In the exemplary embodiment, tab 196 is coupled within slot 266 to secure inner side panel 180 in position to form first side lip 734. An opening formed by rotating inner side panel 180 defines 1008 window 718 in first side wall 706.

Similarly, second inner side panel 224 is rotated about hinge line 228 toward cavity 714 through cutouts 522 and 524. At least a bottom edge of removable tab 526 is separated from reinforcing side panel 518 at perforated line 544 to allow inner side panel 224 to be rotated through cutouts 522 and 524. Removable tab 526 can be removed before, during, or after inner side panel 224 is rotated through cutouts 522 and 524. In the exemplary embodiment, removable tab 526 is removed as inner side panel 224 is rotated. Alternatively, removable tab 526 is removed when container 700 is transitioned from erect configuration 702 to display configuration 748. In the exemplary embodiment, tab 240 is coupled within slot 294 to secure inner side panel 224 in position to form second side lip 738. An opening formed by rotating inner side panel 224 defines 1008 window 722 in second side wall 710.

End insert blanks 600 are then formed 1010 into end inserts 1012 by rotating first reinforcing end assembly 614 toward second reinforcing end assembly 616 about fold line 618. Interior surface 602 of first reinforcing end assembly 614 is adhered to interior surface 602 of second reinforcing end assembly 616 to form end insert 1012. More specifically, interior surfaces 602 of reinforcing end panels 620 are adhered together, and/or interior surfaces 602 of pad panels 624 are adhered together. Each pair of stacking flaps 626 and 628 are rotated toward exterior surface 604 of first reinforcing end assembly 614. In the exemplary embodiment, stacking flaps 626 and 628 are not glued in place. Rather, end insert blank 600 is folded over and glued to itself.

A first end insert 1012 is inserted 1014 into cavity 714 adjacent first end panel assembly 110. More specifically, exterior surface 604 of first reinforcing end assembly 614 is positioned adjacent interior surface 102 of first end panel assembly 110 such that stacking flaps 626 and 628 are positioned between first reinforcing end assembly 614 and first end panel assembly 110. Insert 1012 and first end panel assembly 110 form first end wall 704. End insert 1012 can be adhered to first end panel assembly 110. However, such gluing can be omitted, and end insert 1012 can be removable from cavity 714 to transition container 700 into the knocked-down flat configuration. Similarly, a second end insert 1012 is inserted 1014 into cavity 714 adjacent second end panel assembly 114. More specifically, exterior surface 604 of first reinforcing end assembly 614 is positioned adjacent interior surface 102 of second end panel assembly 114 such that stacking flaps 626 and 628 are positioned between first reinforcing end assembly 614 and second end panel assembly 114. Insert 1012 and second end panel assembly 114 form second end wall 708. End insert 1012 can be adhered to second end panel assembly 114. However, such gluing can be omitted, and second end insert 1012 can be removable from cavity 714 to transition container 700 into the knocked-down flat configuration.

Inner end panels 160 and 204 are rotated toward cavity 714 to define 1016 windows 716 and 720 in end walls 704 and 708, respectively. More specifically, first inner end panel 160 is rotated about hinge line 164 toward cavity 714 through cutouts 622. Tab 176 is coupled within slot 246 to secure inner side panel 160 in position to form first end lip 732. An opening formed by rotating inner end panel 160 defines 1016 window 716 in first end wall 704. Similarly, second inner end panel 204 is rotated about hinge line 208 toward cavity 714 through cutouts 622. Tab 220 is coupled within slot 286 to secure inner side panel 204 in position to form second end lip 736. An opening formed by rotating inner end panel 204 defines 1016 window 720 in second end wall 708. Further, ledge 715 is formed at first end wall 704 and the ledge is formed at second end wall 708 by stacking flaps 626 and 628 forcing reinforcing end panels 620 and pad panels 624 into cavity 714, away from end panel assemblies 110 and 114.

Depending on the type of product 1006 to be contained within container 700, dividers 1018 can be positioned 1020 within cavity 714. Dividers 1018 can be positioned within cavity 714 before or after products 1006 are positioned 1022 within container 700. However, it should be understood that dividers 1018 are not required. Products 1006 are then positioned 1022 within container 700. Windows 716, 718, 720, and/or 722 enable viewing of products 1006 within container 700. A plurality of containers 700 can be stacked 1024 for shipping, storage, and/or display of products 1006. More specifically, an upper container 700 is nested in a lower container 700 such that upper container 700 is at least partially received within cavity 714 of lower container 700. More specifically, bottom wall 712 of the upper container is supported by first end wall ledge 715 and the second end wall ledge. Because ledges 715 orient at least reinforcing end panels 620 to be substantially perpendicular to bottom wall 712, a weight of the upper container is supported in a normal direction by at least reinforcing end panels 620, stacking flap 626, and/or stacking flap 628 at top edge 717.

To facilitate balancing a stack 1026 of containers 700, containers 700 can be alternately rotated by 180°. Indicia, such as "X"s and "O"s, on exterior surface 104 facilitates tracking which orientation a container 700 is in. Such alternate stacking is used because of the arc of blank 100. In an alternative embodiment, containers 700 are stacked 1024 at any suitable orientation. In the exemplary embodiment, stacks 1026 of containers 700 are positioned 1028 on a pallet 1030.

To ship pallet 1030 of stacked containers 700, a top filler 1032 can be constructed 1034 and positioned 1035 on a top of stacks 1026. If a display including pallet 1030 includes a header 1036, header 1036 is positioned 1038 on top filler 1032. Corner boards 1040 are positioned 1042 at corners of pallet 1030, and a top cap 1044 is positioned 1042 on top filler 1032 and/or header 1036. The pallet assembly is then wrapped in, for example, stretch wrap and/or bands. Notably, no additional shroud is required for shipping because containers 700 include pad panels.

Figure 14:
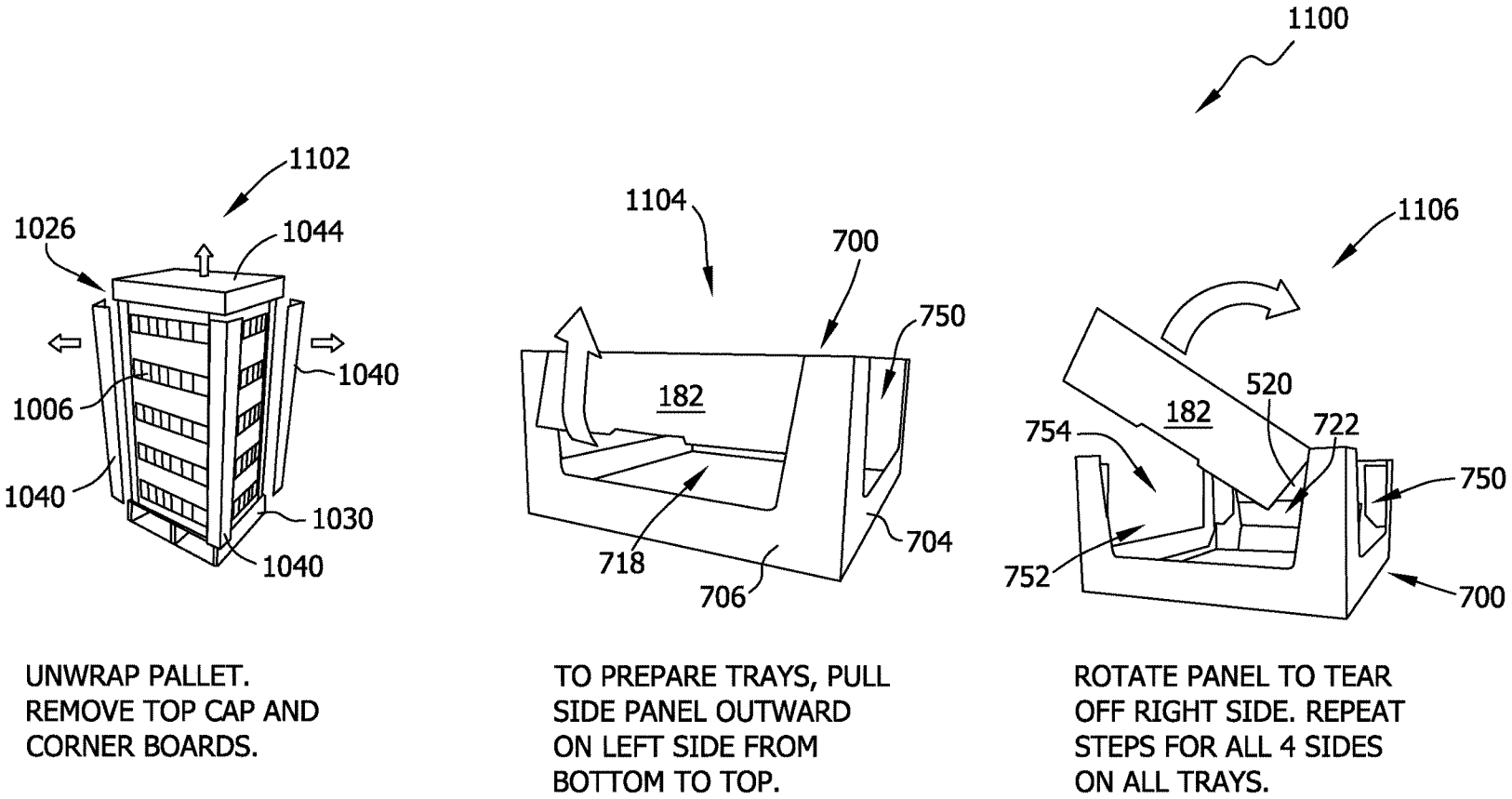

FIG. 14 is a schematic view of an exemplary method 1100 for converting container 700 (shown in FIG. 8) from erect configuration 702 (shown in FIG. 8) to display configuration 748 (shown in FIG. 10). Method 1100 is performed manually to provide a larger opening for viewing and accessing products 1006 within container 700. When containers 700 are received on pallet 1030, top cap 1044, corner boards 1040, header 1036 (shown in FIG. 13B), and/or top filler 1032 (shown in FIG. 13B) are removed 1102 from stack 1026 of containers 700.

Figure 15:
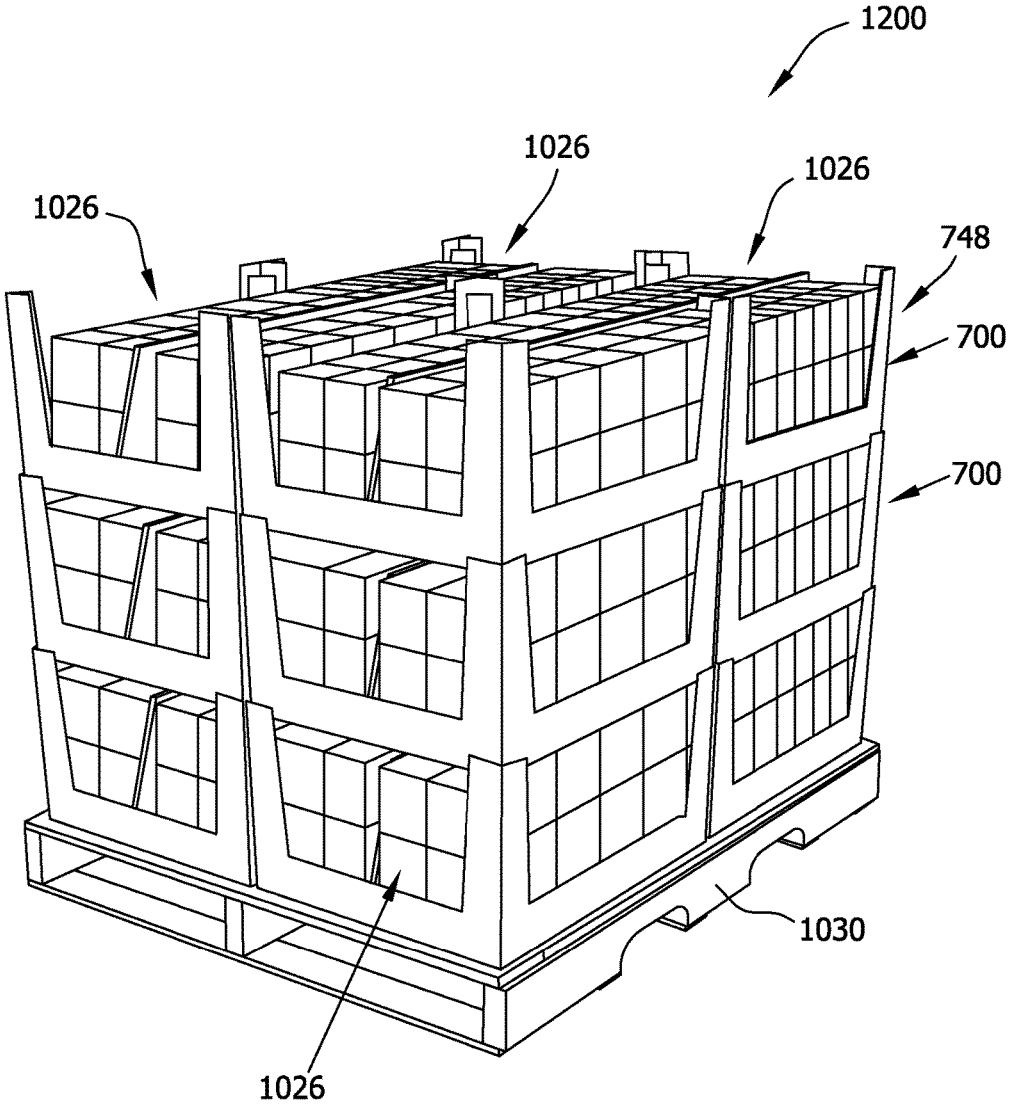

To transition container 700 from erect configuration 702 to display configuration 748, at least one pad panel assembly is removed from container 700. In the exemplary embodiment, pad panels 162, 182, 206, 226, 416, 520, and 624 are removed from walls 704, 706, 708, and 710 to form access openings 750, 752, 754, and 756 in a respective wall 704, 706, 708, or 710. In a particular embodiment, each assembly of pad panels is pulled 1104 outward, away from cavity 714, then rotated 1106 horizontally to remove pad panels. In the exemplary embodiment, pad panels 162 and 624 are removed from first end wall 704, pad panels 182 and 416 are removed from first side wall 706, pad panels 206 and 624 are removed from second end wall 708, and/or pad panels 226 and 520 are removed from second side wall 710. Stacked containers 700 in the display configuration can be used for a point-of-sale display, such as a display 1200 shown in FIG. 15.

The embodiments described herein provide a blank assembly that can be assembled and formed into a knocked-down flat container using at least one machine. More specifically, the container tapers outwardly towards the top thereof, but includes features that facilitate assembling the plurality of blanks into an assembled blank and constructing a knocked-down flat container. The taper of the container enables a first container to be nested in a second, lower container for shipping, storage, and/or display. The above-described container further includes an auto-forming bottom wall that automatically forms as the container is transitioned from a knocked-down flat configuration to an erect configuration. At least one bottom panel extends across a width of the container such that the bottom wall is a full-overlap auto-locking bottom wall. The knocked-down flat container can be shipped to a customer or another location, and can then be erected manually. As such, the receiver of the knocked-down flat container does not need a machine and/or adhesive to finalize formation of the container by erecting the container.

Further, the access opening in each wall of the container allows 360° viewing of and/or access to the products within the container. The pad panels that are removed to create the access openings facilitate reducing shipping material by eliminating the need for a shroud between the products and shrink wrap covering a stack of containers. Moreover, the ledge defined at least partially by the stacking flaps enables the container to support an upper container on the ledges to create a stack of containers. The ledge enables the weight of the upper container to be supported in a direction substantially parallel to gravity, rather than by using a force oriented orthogonally to gravity. As such, a lower container can support the weight of the upper container(s) substantially without buckling outwardly.

Exemplary embodiments of a blank assembly for forming a reinforced, stackable tray container are described above in detail. The methods and apparatus are not limited to the specific embodiments described herein, but rather, components of systems and/or steps of the methods may be utilized independently and separately from other components and/or steps described herein. For example, the methods may also be used in combination with other containers and methods, and are not limited to practice with only the blanks and methods as described herein. Rather, the exemplary embodiment can be implemented and utilized in connection with many other container applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank assembly for forming a reinforced tray container, the blank assembly comprising: a tray blank comprising a plurality of panel assemblies coupled together in series, wherein a first end panel assembly of the plurality of panel assemblies comprises a removable pad panel, an end panel, and an inner end panel extending from the end panel along a hinge line; and a first end insert blank configured to be positioned adjacent the first end panel assembly, the first end insert blank comprising at least one removable pad panel configured to at least partially align with the removable pad panel of the first end panel assembly, wherein the inner end panel is configured to fold over a bottom portion of the first end insert blank when the container is formed from the blank assembly.

2. A blank assembly in accordance with claim 1, wherein the first end insert blank comprises a first reinforcing end assembly and a second reinforcing end assembly connected to each other at a fold line.

3. A blank assembly in accordance with claim 2, wherein the at least one removable pad panel of the first end insert blank is a pair of removable pad panels, each of the first and second reinforcing end assemblies comprises: a reinforcing end panel configured to at least partially align with the end panel of the first end panel assembly; a stacking flap extending from each side edge of the reinforcing end panel; a cutout configured to at least partially align with the inner end panel of the first end panel assembly; and a respective removable pad panel of the pair of removable pad panels, the respective removable pad panel is removable from the reinforcing end panel at a pair of tear lines.

4. A blank assembly in accordance with claim 3, wherein the stacking flaps extending from each side edge of each respective reinforcing end panel are configured to form a portion of a ledge when the container is formed from the blank assembly.

5. A blank assembly in accordance with claim 1, wherein a second end panel assembly of the plurality of panel assemblies comprises a removable pad panel, an end panel, and an inner end panel extending from the end panel along a hinge line, the blank assembly further comprising a second end insert blank configured to be positioned adjacent the second end panel assembly, the second end insert blank comprising at least one removable pad panel configured to at least partially align with the removable pad panel of the second end panel assembly.

6. A blank assembly in accordance with claim 5, wherein the inner end panel of the second end panel assembly is configured to fold over a bottom portion of the second end insert blank when the container is formed from the blank assembly.

7. A blank assembly in accordance with claim 5, wherein each of a first side panel assembly and a second side panel assembly of the plurality of panel assemblies comprises a removable pad panel, a side panel, and an inner side panel extending from the end panel along a hinge line, the blank assembly further comprising: a first side insert blank configured to be coupled to the first side panel assembly, the first side insert blank comprising at least one removable pad panel configured to at least partially align with the removable pad panel of the first side panel assembly; and a second side insert blank configured to be coupled to the second side panel assembly, the second side insert blank comprising at least one removable pad panel configured to at least partially align with the removable pad panel of the second side panel assembly.

8. A reinforced tray container comprising: a pair of opposing side walls; a pair of opposing end walls, a first end wall of the pair of opposing end walls comprises a first end insert positioned adjacent a first end panel assembly, the first end panel assembly comprises a first end panel and a first end pad panel connected to the first end panel, wherein the first end pad panel is configured to be separated from the first end panel for removal from the first end wall, and wherein a first end window is at least partially defined in the first end wall by a first inner end panel of the first end panel assembly folded over a bottom portion of the first end insert; and a bottom wall connected to the pair of side walls and the pair of end walls.

9. A tray container in accordance with claim 8, wherein the first end insert comprises a first reinforcing end assembly and a second reinforcing end assembly connected along a fold line, each reinforcing end assembly comprising: a reinforcing end panel; a stacking flap extending from each side edge of the reinforcing end panel, the stacking flaps configured to form at least a portion of a ledge; a pad panel connected to the reinforcing end panel at a pair of tear lines, the pad panel at least partially aligned with the first end pad panel of the first end panel assembly; and a cutout defined between the pad panel and the reinforcing end panel, the cutout configured to receive the first inner end panel therethrough to at least partially define the first end window.

10. A tray container in accordance with claim 9, wherein each reinforcing end panel and each pad panel of the first and second reinforcing end assemblies is substantially perpendicular to the bottom wall and the first end panel is at an obtuse angle to the bottom wall.

11. A tray container in accordance with claim 9, wherein a top edge of each reinforcing end panel and each pad panel of the first and second reinforcing end assemblies is lower than a top edge of the first end panel to facilitate nesting of an upper container in the tray container.

12. A tray container in accordance with claim 8, wherein a second end wall of the pair of opposing end walls comprises a second end insert positioned adjacent a second end panel assembly, the second end panel assembly comprises a second end panel and a second end pad panel connected to the second end panel, wherein the second end pad panel is configured to be separated from the second end panel for removal from the second end wall, and wherein a second end window is at least partially defined in the second end wall by a second inner end panel of the second end panel assembly folded over a bottom portion of the second end insert.

13. A tray container in accordance with claim 12, wherein a first side wall of the pair of opposing side walls comprises a first side insert positioned adjacent a first side panel assembly, the first side panel assembly comprises a first side panel and a first side pad panel connected to the first side panel, wherein the first side pad panel is configured to be separated from the first side panel for removal from the first side wall, and wherein a first side window is at least partially defined in the first side wall by a first inner side panel of the first side panel assembly folded over a bottom portion of the first side insert.

14. A tray container in accordance with claim 13, wherein a second side wall of the pair of opposing side walls comprises a second side insert positioned adjacent a second side panel assembly, the second side panel assembly comprises a second side panel and a second side pad panel connected to the second side panel, wherein the second side pad panel is configured to be separated from the second side panel for removal from the second side wall, and wherein a second side window is at least partially defined in the second side wall by a second inner side panel of the second side panel assembly folded over a bottom portion of the second side insert.

15. A method for forming a reinforced tray container from a blank assembly, the blank assembly includes a tray blank comprising a plurality of panel assemblies coupled together in series, wherein a first end panel assembly of the plurality of panel assemblies comprises a removable pad panel, an end panel, and an inner end panel extending from the end panel along a hinge line, the blank assembly further includes a first end insert blank having at least one removable pad panel, the method comprising: positioning the first end insert blank adjacent to the first end panel assembly such that the at least one removable pad panel of the first end insert blank is substantially aligned with the removable pad panel of the first end panel assembly; and folding the inner end panel of the first end panel assembly over a bottom portion of the first end insert blank to define a first end window in a first end wall of a pair of opposing end walls.

16. A method in accordance with claim 15, wherein the at least one removable pad panel of the first end insert blank is a pair of removable pad panels, the first end insert blank comprises a first reinforcing end assembly and a second reinforcing end assembly connected to each other at a fold line, each of the first and second reinforcing end assemblies comprises a respective removable pad panel of the pair of removable pad panels, the method further comprising rotating the first reinforcing end assembly toward the second reinforcing end assembly about the fold line.

17. A method in accordance with claim 16, wherein each of the first and second reinforcing end assemblies further comprises a stacking flap extending from each side edge of the respective reinforcing end panel, the method further comprising positioning the stacking flaps between the first reinforcing end panel and the end panel of the first end panel assembly, such that the stacking flaps at least partially define a ledge of the first end wall.

18. A method in accordance with claim 15, wherein a second end panel assembly of the plurality of panel assemblies comprises a removable pad panel, an end panel, and an inner end panel extending from the end panel along a hinge line, the blank assembly further includes a second end insert blank having at least one removable pad panel, the method further comprising: positioning the second end insert blank adjacent to the second end panel assembly such that the at least one removable pad panel of the second end insert blank is substantially aligned with the removable pad panel of the second end panel assembly; and folding the inner end panel of the second end panel assembly over a bottom portion of the second end insert blank to define a second end window in a second end wall of the pair of opposing end walls.

19. A method in accordance with claim 18, wherein each of a first and second side panel assembly of the plurality of panel assemblies comprises a removable pad panel, a side panel, and an inner side panel extending from the respective side panel along a hinge line, the blank assembly further includes a first side insert blank and a second side insert blank each having at least one removable pad panel, the method further comprising: positioning the first side insert blank adjacent to the first side panel assembly such that the at least one removable pad panel of the first side insert blank is substantially aligned with the removable pad panel of the first side panel assembly; positioning the second side insert blank adjacent to the second side panel assembly such that the at least one removable pad panel of the second side insert blank is substantially aligned with the removable pad panel of the second side panel assembly; folding the inner side panel of the first side panel assembly over a bottom portion of the first side insert blank to define a first side window in a first side wall of a pair of opposing side walls; and folding the inner side panel of the second side panel assembly over a bottom portion of the second side insert blank to define a second side window in a second side wall of the pair of opposing side walls.

20. A blank assembly for forming a reinforced tray container, the blank assembly comprising: a tray blank comprising a plurality of panel assemblies coupled together in series, wherein a first end panel assembly of the plurality of panel assemblies comprises a removable pad panel and an end panel; and a first end insert blank configured to be positioned adjacent the first end panel assembly, the first end insert blank comprising: at least one removable pad panel configured to at least partially align with the removable pad panel of the first end panel assembly; a reinforcing end panel configured to at least partially align with the end panel of the first end panel assembly; and a stacking flap extending from each side edge of the reinforcing end panel, the stacking flaps configured to be positioned between the reinforcing end panel and the end panel of the first end panel assembly to form at least a portion of a ledge when the container is formed from the blank assembly.

* * * * *